US010286695B2

(12) United States Patent
Moriyama et al.

(10) Patent No.: US 10,286,695 B2
(45) Date of Patent: May 14, 2019

(54) LIQUID EJECTING APPARATUS WITH TUBE GUIDE AND CURVED LIQUID TUBE

(71) Applicant: SEIKO EPSON CORPORATION, Tokyo (JP)

(72) Inventors: Ryuji Moriyama, Matsumoto (JP); Makoto Sato, Matsumoto (JP); Hisayuki Akahane, Matsumoto (JP); Toshiki Shiroki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/793,570

(22) Filed: Oct. 25, 2017

(65) Prior Publication Data

US 2018/0126759 A1 May 10, 2018

(30) Foreign Application Priority Data

Nov. 4, 2016 (JP) ..... 2016-215871
Apr. 3, 2017 (JP) ..... 2017-073840

(51) Int. Cl.

| | |
|---|---|
| ***B41J 19/00*** | (2006.01) |
| ***B41J 2/175*** | (2006.01) |
| ***B41J 29/02*** | (2006.01) |
| ***B41J 29/13*** | (2006.01) |
| ***B41J 25/304*** | (2006.01) |

(52) U.S. Cl.

CPC ..... *B41J 25/304* (2013.01); *B41J 2/175* (2013.01); *B41J 2/1752* (2013.01); *B41J 2/17523* (2013.01); *B41J 2/17553* (2013.01); *B41J 19/005* (2013.01); *B41J 29/13* (2013.01); *B41J 29/02* (2013.01)

(58) Field of Classification Search

CPC ..... B41J 25/304; B41J 19/005; B41J 29/13; B41J 2/1752; B41J 2/17523; B41J 2/17553; B41J 2/175; B41J 29/02

See application file for complete search history.

(56) References Cited

U.S. PATENT DOCUMENTS

| | | | | |
|---|---|---|---|---|
| 8,430,487 | B2 * | 4/2013 | Sekino | B41J 2/175 347/86 |
| 9,827,770 | B2 * | 11/2017 | Takei | B41J 2/1752 |
| 2009/0167825 | A1 | 7/2009 | Kawamura et al. | |
| 2009/0167834 | A1 | 7/2009 | Kuriki | |

(Continued)

FOREIGN PATENT DOCUMENTS

| | | | |
|---|---|---|---|
| JP | 2009-160742 | A | 7/2009 |
| JP | 2009-160779 | A | 7/2009 |

(Continued)

*Primary Examiner* — Bradley W Thies

(74) *Attorney, Agent, or Firm* — Workman Nydegger

(57) ABSTRACT

A liquid ejecting apparatus includes a carriage that includes a liquid ejecting head, a liquid storing container that is capable of storing the liquid and that is provided at a different location from the carriage, a tube that supplies the liquid sent from the liquid storing container, and a guide section that is located at a lower side of the carriage in a vertical direction. When one of the moving directions of the carriage is a first direction and another one of the moving directions of the carriage is a second direction, the tube extends in the second direction along the guide section, and is connected to the carriage. The guide section includes a first site and a second site that is lower in the vertical direction than the first site.

13 Claims, 30 Drawing Sheets

(56) References Cited

U.S. PATENT DOCUMENTS

| | | | | |
|---|---|---|---|---|
| 2012/0050416 | A1* | 3/2012 | Ishizawa | B41J 2/175 347/85 |
| 2014/0043409 | A1 | 2/2014 | Suzuki et al. | |
| 2015/0283832 | A1 | 10/2015 | Osakabe et al. | |

FOREIGN PATENT DOCUMENTS

| | | | |
|---|---|---|---|
| JP | 2012-076224 | A | 4/2012 |
| JP | 2014-034192 | A | 2/2014 |
| JP | 2015-199264 | A | 11/2015 |

* cited by examiner

LIQUID EJECTING APPARATUS WITH TUBE GUIDE AND CURVED LIQUID TUBE

BACKGROUND

1. Technical Field

The present invention relates to a liquid ejecting apparatus that ejects a liquid.

2. Related Art

An example of a liquid ejecting apparatus that ejects a liquid is an ink jet printer. Among such ink jet printers there exists a so-called serial type ink jet printer that includes a recording head as a liquid ejector that ejects ink as an example of a liquid and that further includes a carriage movable in a predetermined direction.

Furthermore, some ink jet printers include an ink container that contains ink provided on a carriage while other ink jet printers include an ink container outside of or apart from a carriage. In an ink jet printer that has an ink container outside of the carriage, the ink container and the carriage (recording head) are connected by a tube for supplying ink (hereinafter, referred to as "ink tube").

The ink tube extends out from the carriage, and is bent so as to form a curved portion and laid out so as to extend toward the ink container. Then, the ink tube deforms following movements of the carriage.

JP-A-2012-076224 discloses a configuration in which an ink tube is fixed, via a fixture member, to a tube guide that extends in the moving directions of the carriage. As the carriage moves, the position on the ink tube at which a curved portion is formed shifts along the ink tube while the ink tube is in pressing contact with the tube guide. Note that a protective plate is provided between the ink tube and the tube guide.

In recent years, further size reduction of printer apparatuses is demanded. However, a size reduction of a printer apparatus results in a reduced space in which the ink tube can be laid out. When the space in which the ink tube can be laid out is reduced in size, the curved portion of the ink tube inevitably needs to have an increased curvature (be more sharply curved). As a result, unfavorable bending stress may occur in the ink tube and may adversely affect the endurance of the ink tube. Furthermore, the curved portion of the ink tube may strongly contact the tube guide, causing abrasion of an ink tube surface and the tube guide.

Still further, since the carriage receives force from the ink tube, inappropriately curved state of the curved portion of the ink tube or a change in the curved state of the curved portion during movement of the carriage may cause unstable behavior of the carriage, resulting in degraded recording quality.

SUMMARY

An advantage of some aspects of the invention is that a liquid ejecting apparatus capable of inhibiting damage to a tube or a tube guide while achieving an apparatus size reduction is provided.

Another advantage of some aspects of the invention is that unstable behavior of the carriage and therefore declined recording quality resulting from the carriage receiving force from the tube are inhibited.

One aspect of the invention provides a liquid ejecting apparatus that includes a carriage unit that includes a liquid ejecting head for ejecting a liquid to a medium and that moves back and forth in a scanning direction of the liquid ejecting head, a liquid storing container which is capable of storing the liquid that is to be ejected from the liquid ejecting head and which is provided at a different location from the carriage unit, a tube that is connected to the carriage unit and that supplies the carriage unit with the liquid sent from the liquid storing container, and a guide section that is located at a lower side of the carriage unit in a vertical direction and that restricts deformation of the tube occurring as the carriage unit moves and that extends along moving directions of the carriage unit. When one of the moving directions of the carriage unit is a first direction and another one of the moving directions of the carriage unit is a second direction, the tube extends in the second direction along the guide section, forms a curved portion that curves vertically upward, turns back into the first direction, and then is connected to the carriage unit. The guide section includes a first site and a second site that is lower in the vertical direction than the first site.

According to this aspect of the invention, since the guide section that restricts deformation of the tube includes the first site and the second site that is lower in the vertical direction than the first site, it is possible to appropriately form the curved portion due to the second site while reducing the size of the apparatus and to prevent or reduce damage to the tube or the guide section.

In the liquid ejecting apparatus according to the first aspect of the invention, the second site may be provided at such a location as to receive the curved portion of the tube when the carriage unit is at an end portion of a movable range of the carriage unit in the second direction.

Since the tube extends in the second direction along the guide section, forms the curved portion, turns back into the first direction, and then is connected to the carriage unit, the curved portion contacts the guide section most strongly when the carriage unit is at end portion of the movable range of the carriage unit in the second direction.

According to the foregoing embodiment of the first aspect of the invention, since the second site is located at such a location as to receive the curved portion of the tube when the carriage unit is at the end portion of the movable range in the second direction, the pressing contact of the curved portion with the guide section can be eased, so that damage to the tube or the guide section can be effectively inhibited.

In another embodiment of the liquid ejecting apparatus of the first aspect of the invention, the second site may be lower in rigidity than at least the first site.

According to this embodiment, since the second site is lower in rigidity than at least the first site, damage inflicted on the tube when the tube pressingly contacts the second site can be inhibited.

In still another embodiment of the foregoing liquid ejecting apparatus, the second site may have an inclined surface extending in a direction away from the tube or a recess surface that dips in a direction away from the tube.

According to this embodiment, the operation and effects as described above can be achieved in the configuration in which the second site has the inclined surface extending in a direction away from the tube or the recess surface that dips in a direction away from the tube.

In a further embodiment of the foregoing liquid ejecting apparatus, the guide section may be located above a medium transport path.

According to this embodiment, the operation and effects as described above can be achieved in the configuration in which the guide section is located above the medium transport path.

In a further embodiment of the liquid ejecting apparatus, the second site may be located outside the medium transport path in the moving directions of the carriage unit.

According to this embodiment, since the second site is located outside the medium transport path in the moving directions of the carriage unit, the second site and the medium transport path do not overlap with each other when seen in apparatus height direction, so that the dimension of the apparatus in the apparatus height direction can be reduced.

In a further embodiment of the first aspect of the invention, the liquid ejecting apparatus may further include a medium discharge roller pair that is provided at a downstream side of the liquid ejecting head in the medium transport path and that includes a driving discharge roller and a driven discharge roller that together send out the medium, and a roller support frame that is provided between the medium transport path and the guide section and that supports the driven discharge roller. The roller support frame may be displaceable in such a direction that an interval between the roller support frame and the medium transport path changes, and the first site of the guide section may be displaced in a displacement direction of the roller support frame in association with the roller support frame.

According to this embodiment, since, in the configuration in which the roller support frame is displaceable in such a direction as to change the interval between the roller support frame and the medium transport path, the first site of the guide section is displaced in the displacement direction of the roller support frame in association with the roller support frame, the need to secure a large space between the roller support frame and the guide section is eliminated, so that increase in the size of the apparatus can be inhibited.

In a further embodiment of the foregoing liquid ejecting apparatus, the carriage unit may include a curved guide portion that curves the tube so that the tube follows a curve of the curved portion of the tube.

According to this embodiment, since the carriage unit includes the curved guide portion that curves the tube so that the tube follows the curve of the curved portion of the tube, the curved portion of the tube can be easily formed.

In a further embodiment of the first aspect of the invention, the liquid ejecting apparatus may further include a plurality of the tube, a clamp that bundles the plurality of the tube, a first protective member that covers and protects at least a first portion of the tubes in a length direction of the tubes which extends from the curved portion toward the carriage unit and at least a second portion of the tubes in the length direction of the tubes which extends from the curved portion toward the liquid storing container, the first portion and the second portion together including an outer side of the curved portion of the tubes, an enclosing portion that is provided integrally together with the first protective member and that encloses the clamp, and a second protective member that is provided at an inner side of the curved portion of the tubes and interposed between the clamp and the enclosing portion and that covers and protects at least a portion of the tubes in a length direction of the tubes which extends from the enclosing portion toward the carriage unit and at least a portion of the tubes in the length direction of the tube which extends from the enclosing portion toward the liquid storing container.

According to this embodiment, the clamp can hold the tubes together, the first protective member can protect the tubes, and the enclosing portion can integrate the tubes, the clamp, and the first protective member together. In this configuration, due to the second protective member that is provided at the inner side of the curved portion of the tubes and interposed between the clamp and the enclosing portion and that extends from the enclosing portion in both opposite longitudinal directions of the tubes, it is possible to prevent the enclosing portion from digging into the tubes.

In a further embodiment of the first aspect of the liquid ejecting apparatus of the invention, the second protective member may be lower in rigidity than the first protective member.

According to this embodiment, since the second protective member is lower in rigidity than the first protective member, it is possible to avoid the second protective member digging into the tubes.

In a further embodiment of the foregoing ink ejecting apparatus, an end portion of the second protective member in a longitudinal direction of the tube may have such a relieving shape as to avoid digging of the end portion into the tube.

According to this embodiment, since the aforementioned end portion of the second protective member in the longitudinal direction of the tubes has the relieving shape that avoids digging into the tubes, it is possible to certainly avoid the digging of the second protective member into the tubes.

A second aspect of the invention provides a liquid ejecting apparatus that includes a carriage unit that includes a liquid ejecting head for ejecting a liquid to a medium and that moves back and forth in a scanning direction of the liquid ejecting head, a liquid storing container which is capable of storing the liquid that is to be ejected from the liquid ejecting head and which is provided at a different location from the carriage unit, a tube that is connected to the carriage unit and that supplies the carriage unit with the liquid sent from the liquid storing container, and a guide section that is located at a lower side of the carriage unit in a vertical direction and that restricts deformation of the tube occurring as the carriage unit moves and that extends along moving directions of the carriage unit. When one of the moving directions of the carriage unit is a first direction and another one of the moving directions of the carriage unit is a second direction, the tube extends in the second direction along the guide section, forms a curved portion that curves vertically upward, turns back into the first direction, and then is connected to the carriage unit. The carriage unit includes a restricting portion that restricts an extending-out direction in which the tube extends out from the carriage unit toward a direction away from the guide section.

According to this aspect of the invention, since the carriage unit includes the restricting portion that restricts the extending-out direction in which the tube extends out from the carriage unit toward a direction away from the guide section, the tube is restricted so that the radius of the curved portion is maximized. Therefore, changes in the force that the carriage unit receives from the tube when the carriage unit is moved can be inhibited. As a result, destabilization of behavior of the carriage unit and therefore deterioration of recording quality occurring due to the carriage unit receiving forces from the tube can be inhibited.

A third aspect of the invention provides a liquid ejecting apparatus that includes a carriage unit that includes a liquid ejecting head for ejecting a liquid to a medium and that moves back and forth in a scanning direction of the liquid ejecting head, a liquid storing container which is capable of storing the liquid that is to be ejected from the liquid ejecting head and which is provided at a different location from the carriage unit, a tube that is connected to the carriage unit and that supplies the carriage unit with the liquid sent from the liquid storing container, a guide section that is located at a lower side of the carriage unit in a vertical direction and that restricts deformation of the tube occurring as the carriage unit moves and that extends along moving directions of the carriage unit, and an opening/closing body that is located at an upper side of the carriage unit in a vertical direction and that opens and closes a region of back and forth movements of the carriage unit. When one of the moving directions of the carriage unit is a first direction and another one of the moving directions of the carriage unit is a second direction, the tube extends in the second direction along the guide section, forms a curved portion that curves vertically upward, turns back into the first direction, and then is connected to the carriage unit. The carriage unit includes a restricting portion that restricts an extending-out direction in which the tube extends out from the carriage unit toward a direction toward the opening/closing body.

If the ink supply tub extending out from the carriage unit sometimes contacts and some other times does not contact the opening/closing body located above the region of back and forth movements of the carriage unit, the force that the carriage unit receives from the tube when the carriage unit is moved changes and therefore behavior of the carriage unit becomes unstable.

However, according to this configuration, since the carriage unit includes the restricting portion that restricts the extending-out direction of the tube extending out from the carriage unit to a direction toward the opening/closing body, the range over which the tube contacts can be extended. As a result, the force that the carriage unit receives from the ink supply tubes during moving actions of the carriage unit is inhibited from changing, so that it is possible to inhibit destabilization of behavior of the carriage unit and therefore deterioration of recording quality.

In an embodiment of the second or third aspect of the invention, the liquid ejecting apparatus may further include a first protective member that covers and protects at least a first portion of the tube in a length direction of the tube which extends from the curved portion toward the carriage unit and at least a second portion of the tube in the length direction of the tube which extends from the curved portion toward the liquid storing container, the first portion and the second together including an outer side of the curved portion of the tubes. The first protective member may have in at least a region in the first protective member which protects the curved portion a slit formed along the length direction of the tube.

According to this embodiment, since the first protective member has at least in the portion thereof that protects the curved portion the slit formed in the length directions of the tube, the rigidity of the first protective member can be reduced, so that the force that the carriage unit receives from the first protective member can be inhibited. As a result, destabilization of behavior of the carriage unit and therefore deterioration of recording quality occurring due to the carriage unit receiving force from the first protective member can be inhibited.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
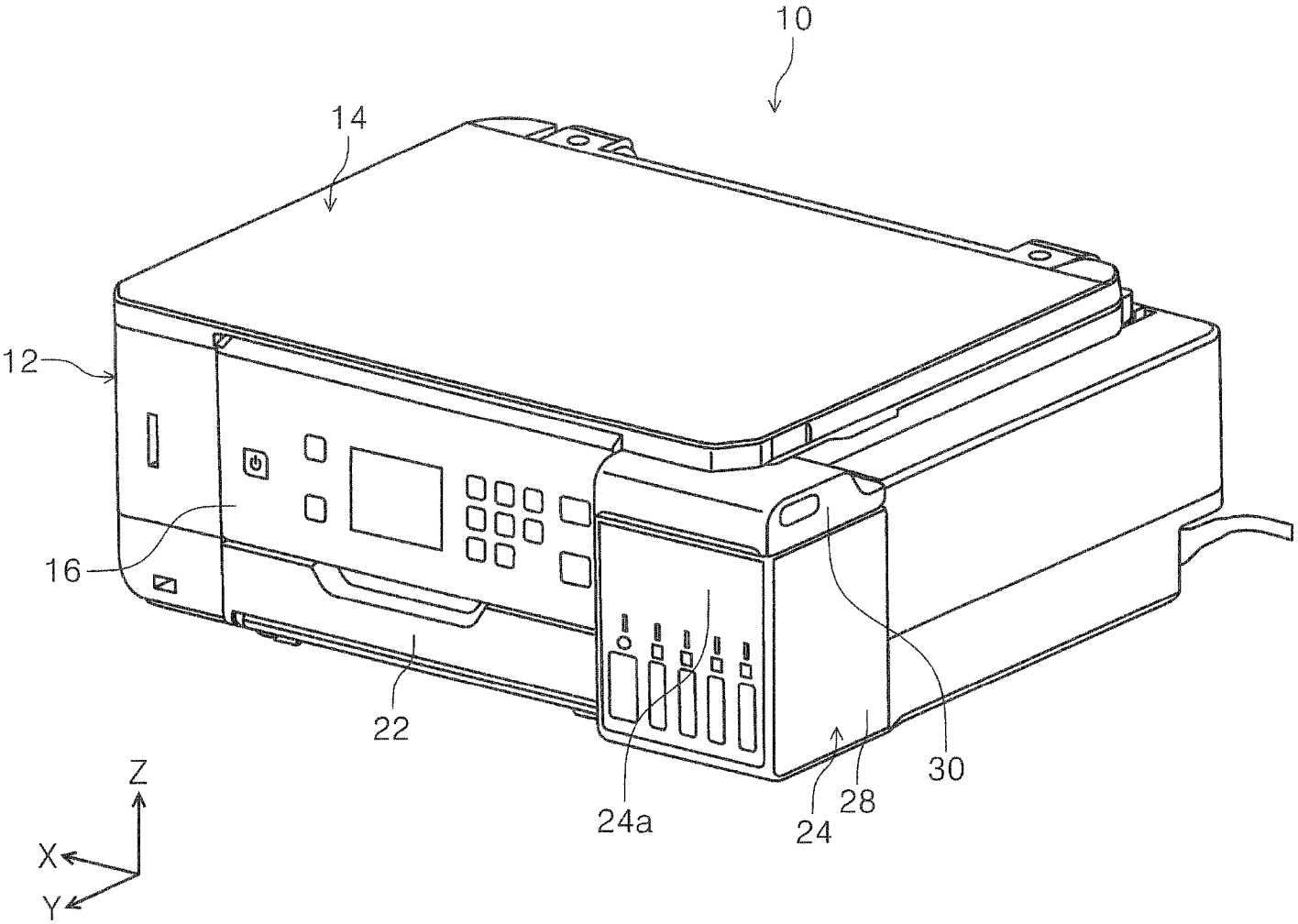
FIG. 1 is an external perspective view of a printer according to the invention.

Exemplary embodiments of the invention will be described hereinafter with reference to the drawings. In the following exemplary embodiments, like configurations will be represented by like reference characters and will be described only when mentioned for the first time and not be described redundantly when mentioned for the second or subsequent time.

Figure 2:
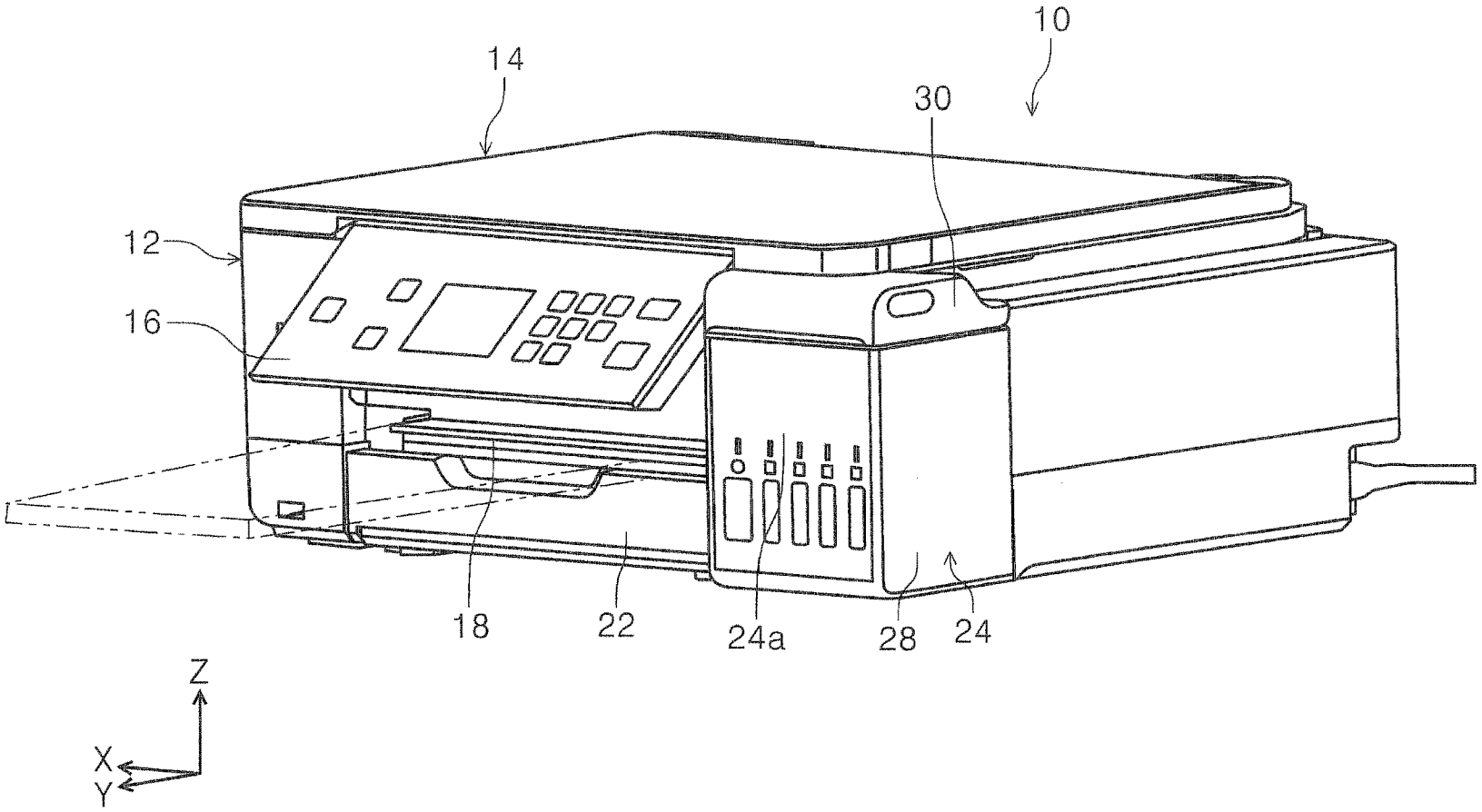
FIG. 2 is an external perspective view of the printer in a state in which an operating portion has been pivoted a front side in apparatus depth directions.
Figure 3:
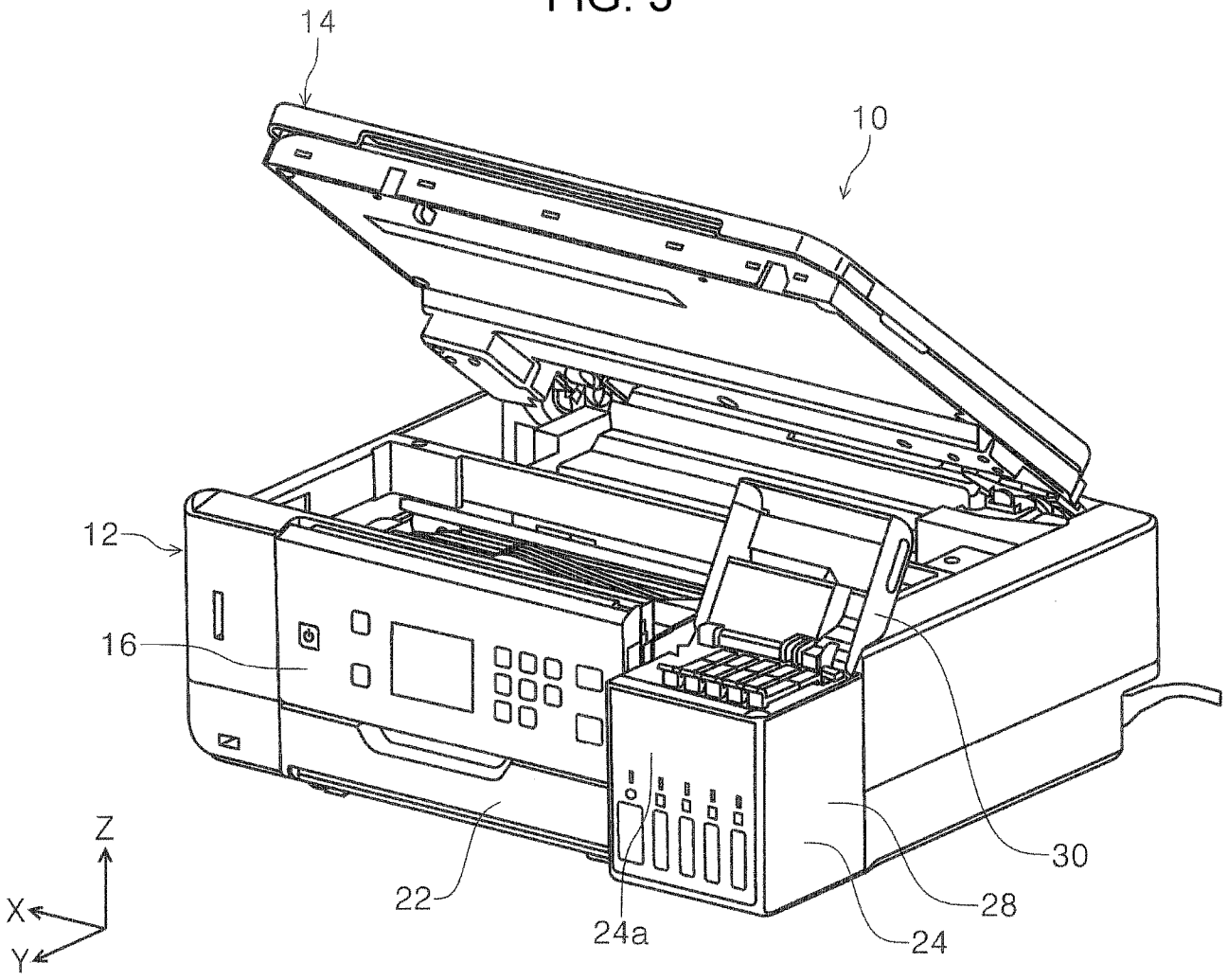
FIG. 3 is an external perspective view of the printer when a scanner portion and a cover of an ink tank are in an open state relative to an apparatus body.
Figure 4:
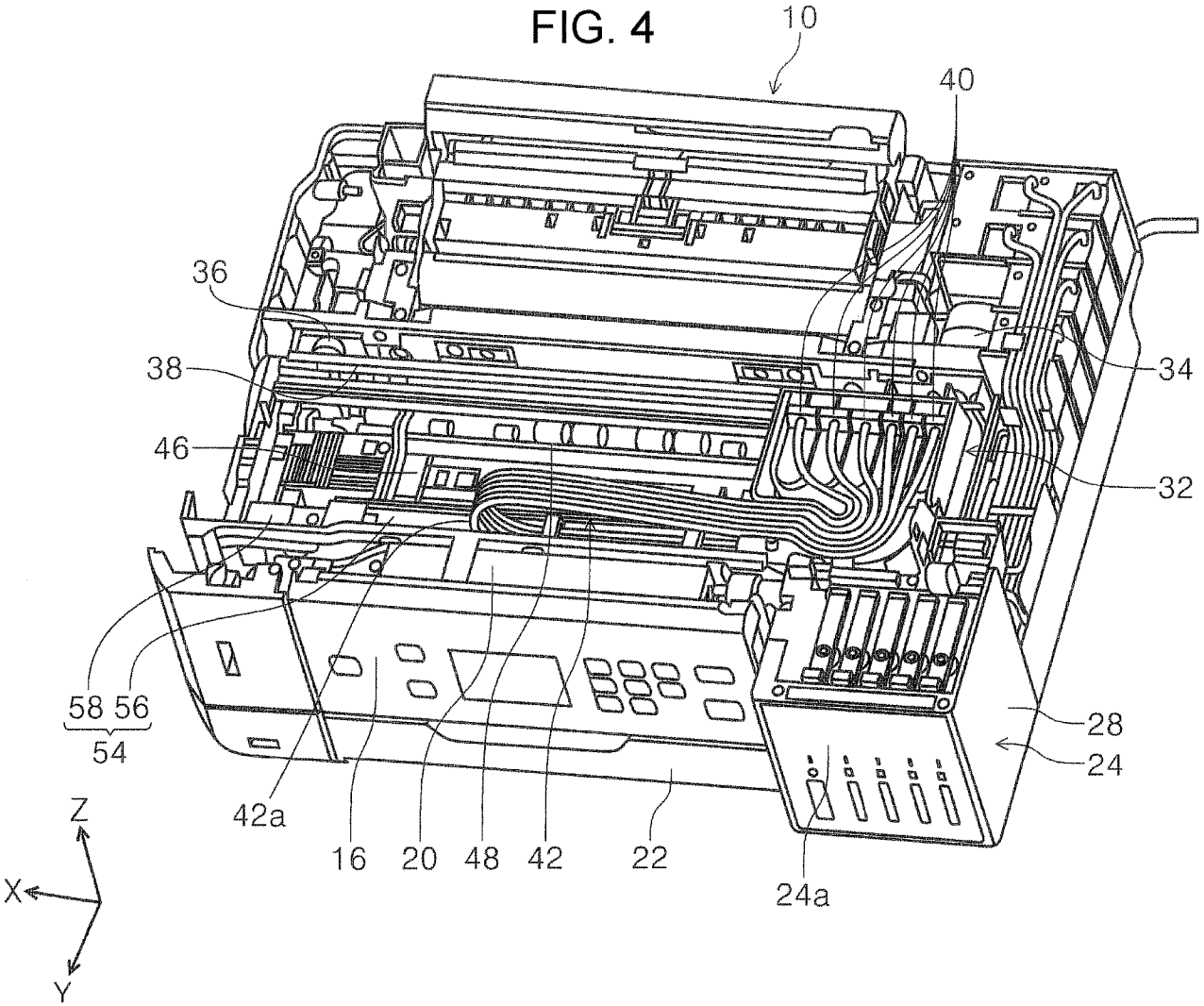
FIG. 4 is an external perspective view of the apparatus body.
Figure 5:
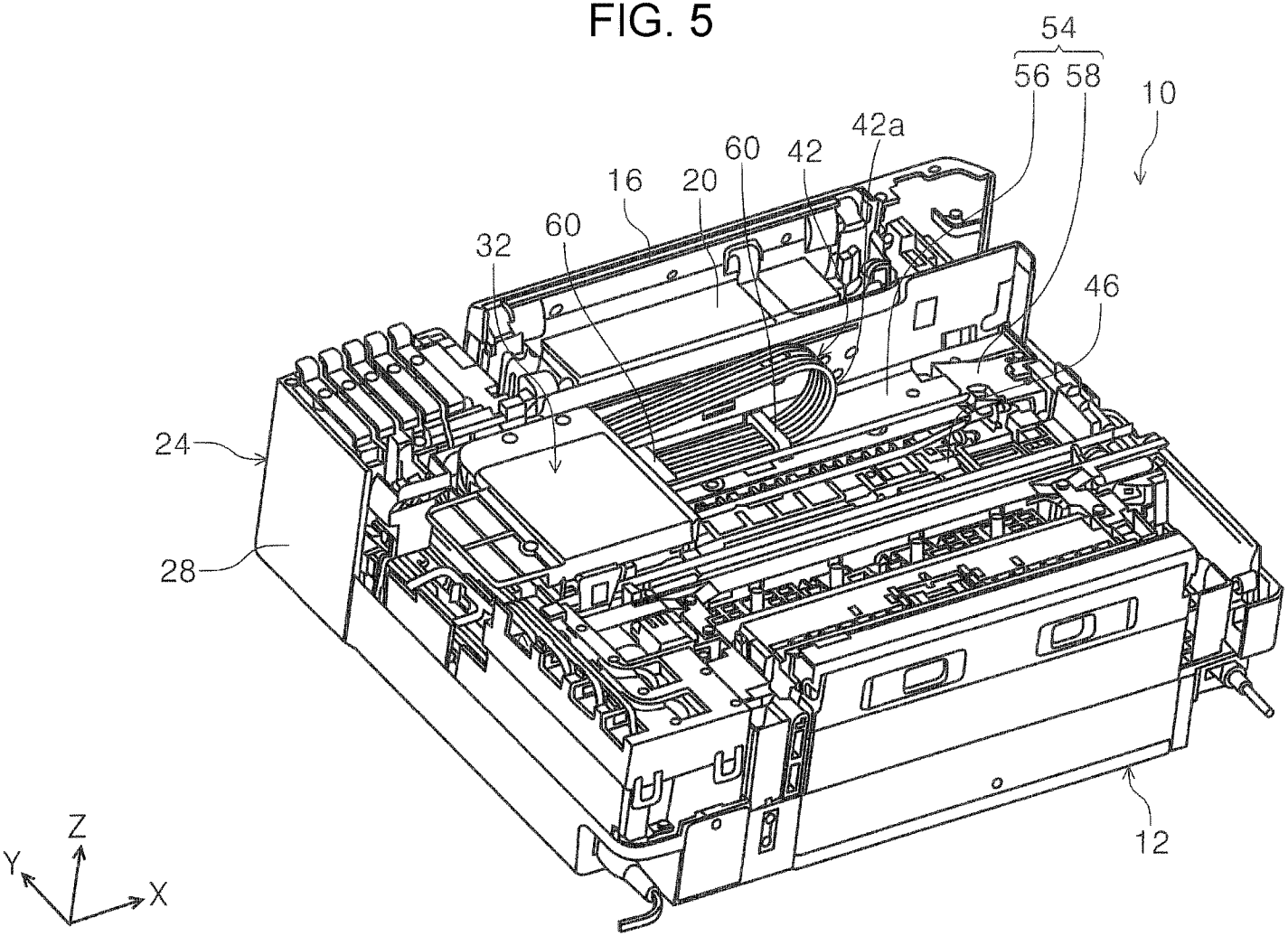
FIG. 5 is an external perspective view of the apparatus body seen from a rear side in the apparatus depth directions.
Figure 6:
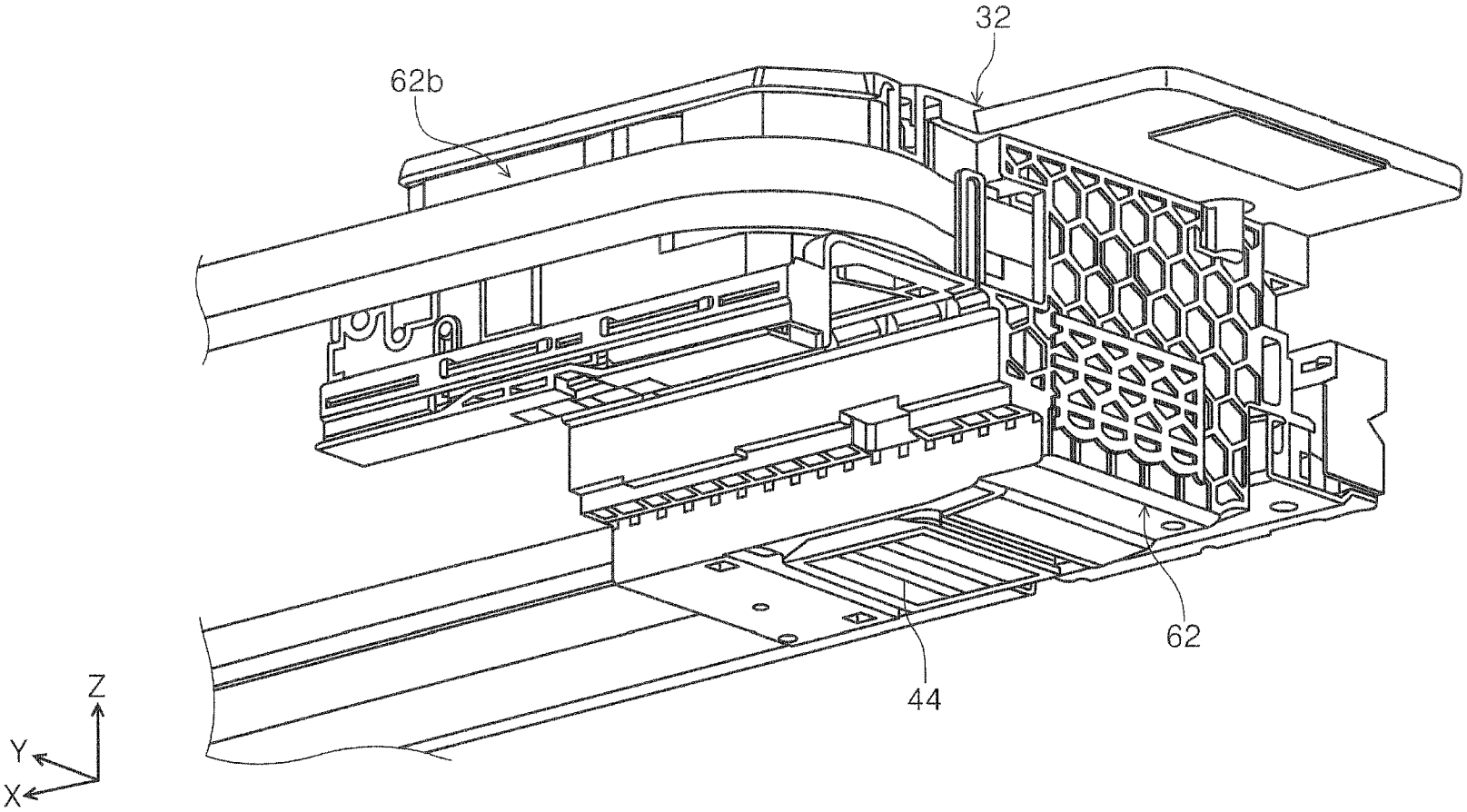
FIG. 6 is a perspective view of a carriage seen from obliquely below in apparatus height directions.
Figure 7:
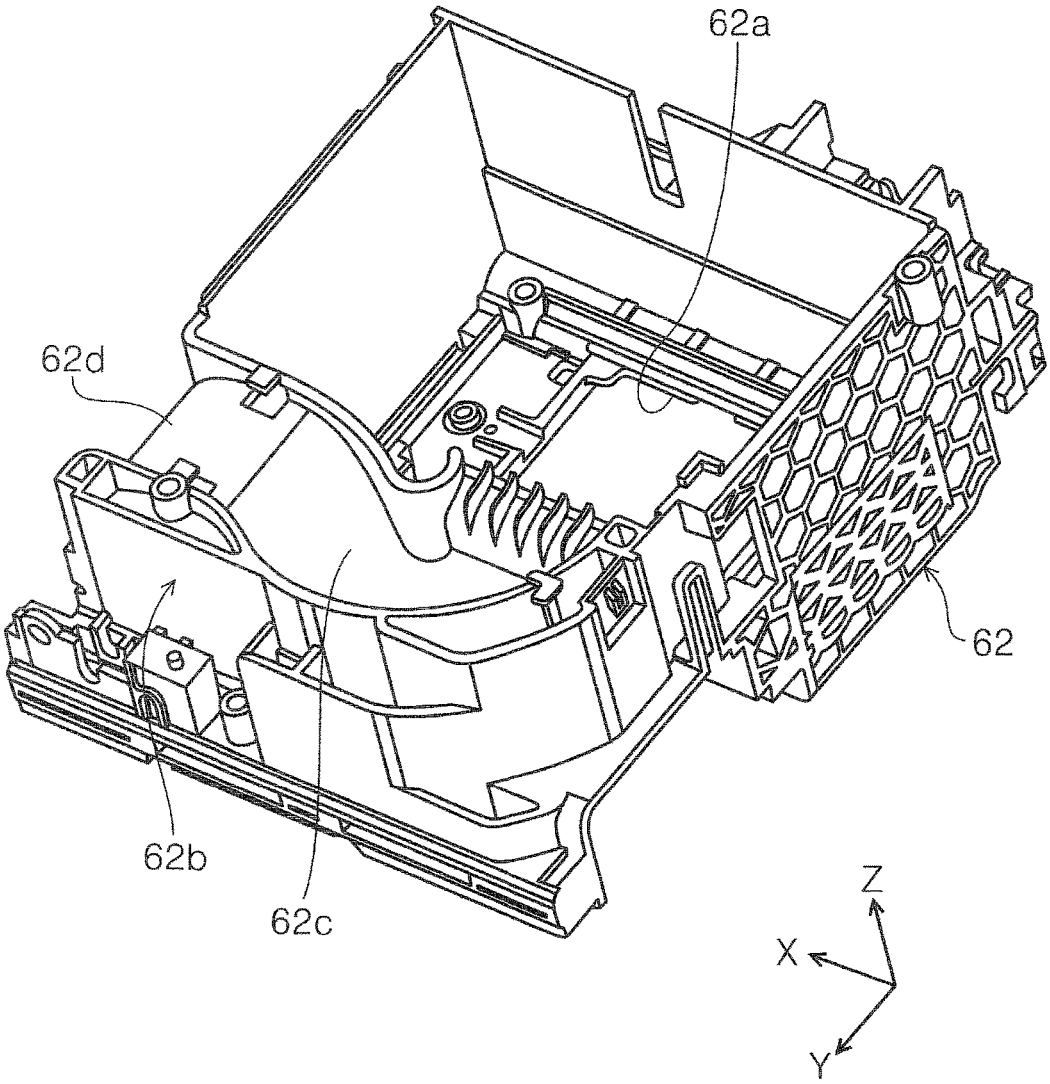
FIG. 7 is a perspective view of a casing of the carriage.

FIG. 1 is an external perspective view of a printer according to the invention. FIG. 2 is an external perspective view of the printer in a state in which an operating portion of the printer has been pivoted to a front side in apparatus depth directions. FIG. 3 is an external perspective view of the printer when a scanner portion and a cover of an ink tank are in an open state relative to an apparatus body of the printer. FIG. 4 is an external perspective view of the apparatus body. FIG. 5 is an external perspective view of the apparatus body seen from a rear side in the apparatus depth directions. FIG. 6 is a perspective view of a carriage seen obliquely from a lower side in apparatus height directions. FIG. 7 is a perspective view of a casing of the carriage.

Figure 8:
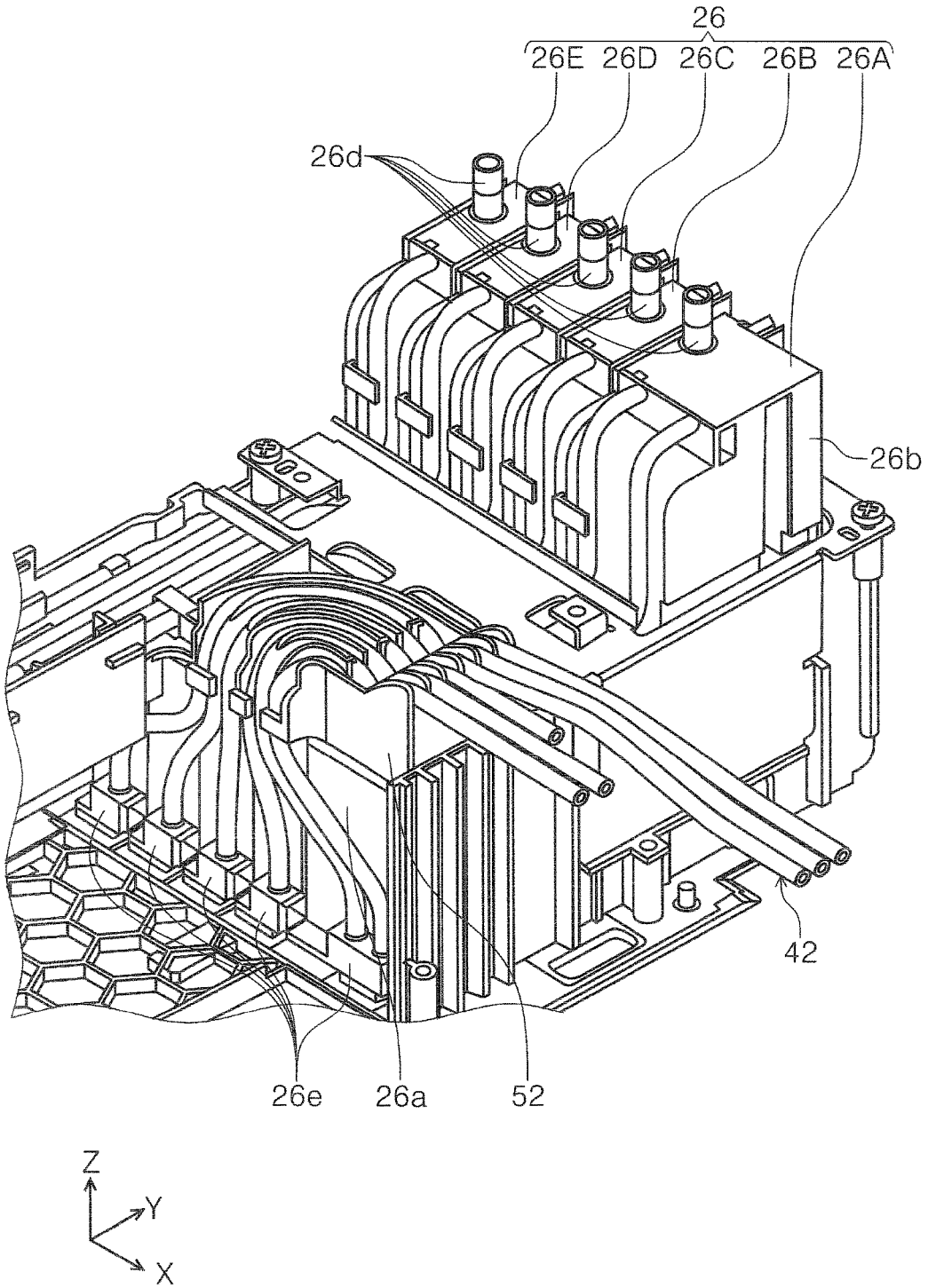
FIG. 8 is a perspective view of an ink tank section seen from the rear side in the apparatus depth directions.
Figure 9:
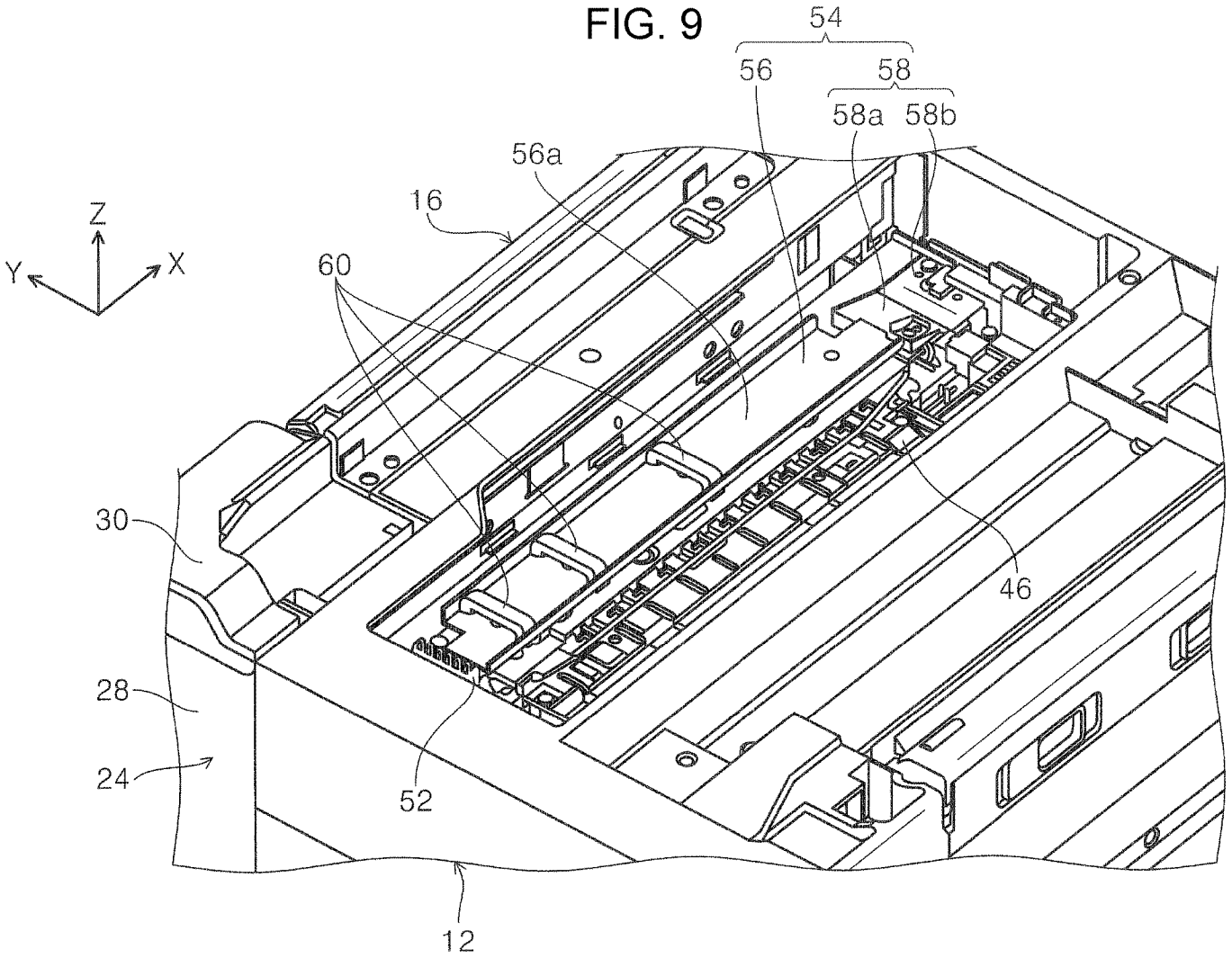
FIG. 9 is a perspective view of a guide section provided on the apparatus body.
Figure 10:
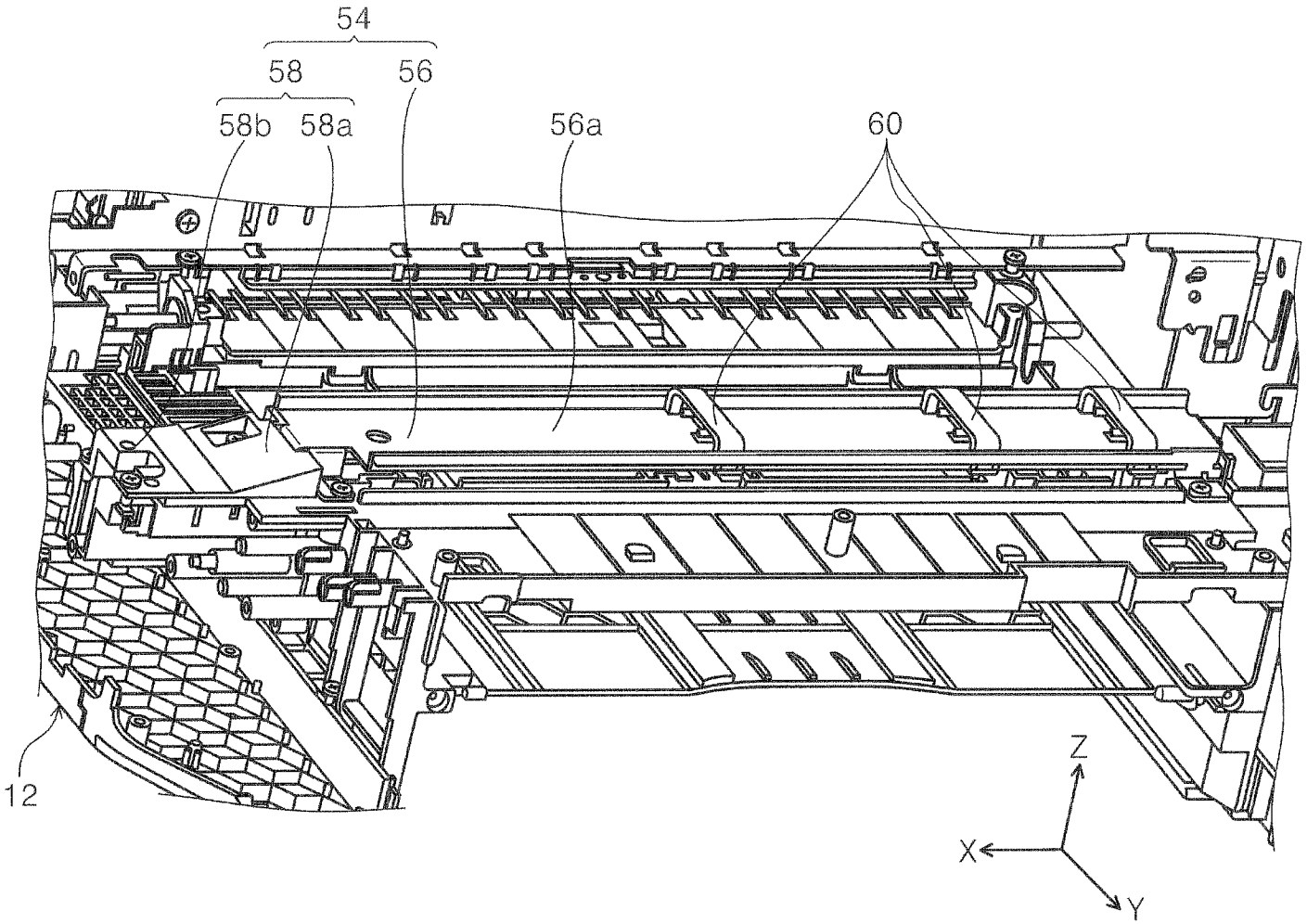
FIG. 10 is a perspective view of the guide section seen from a front side in the apparatus depth directions.
Figure 11:
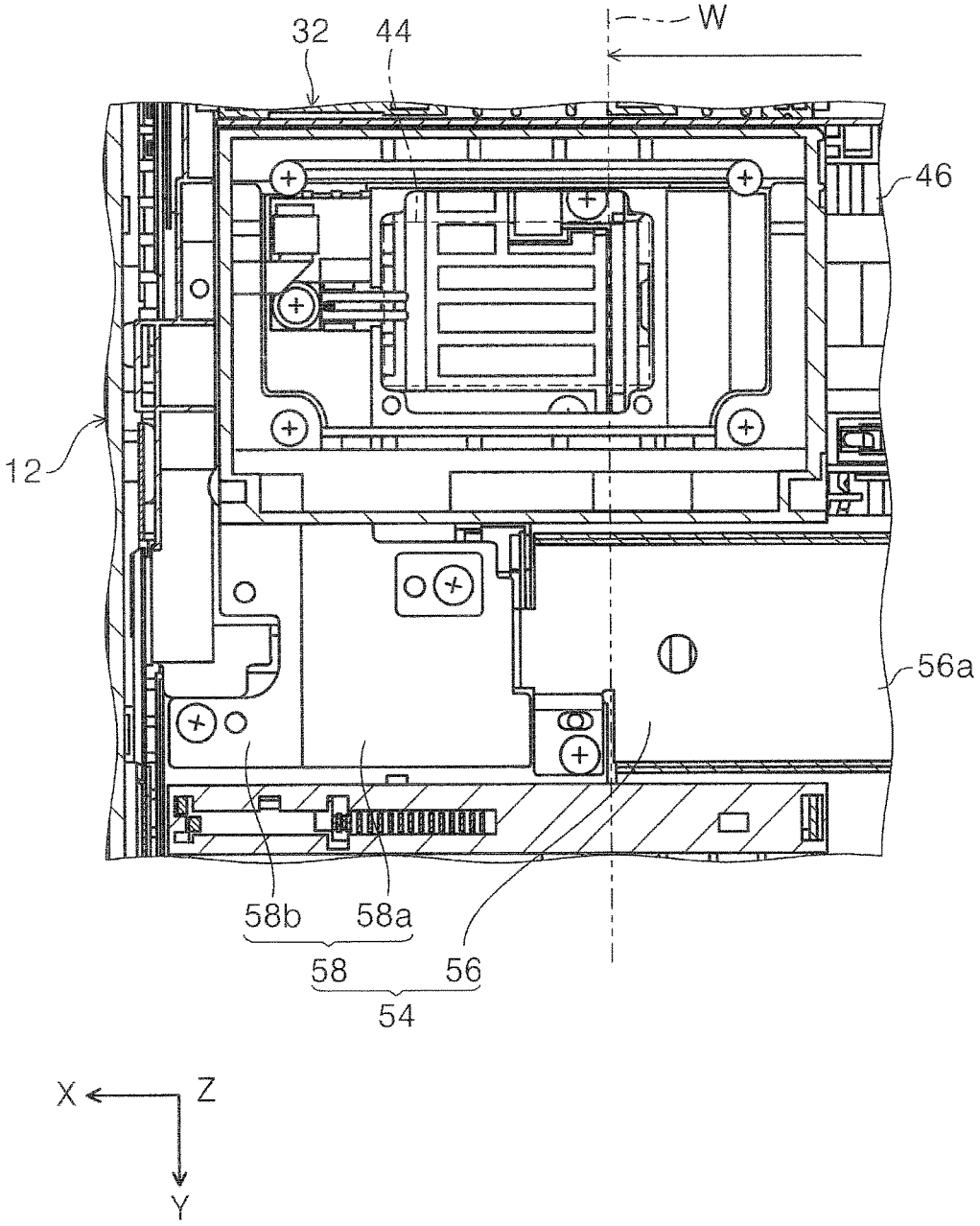
FIG. 11 is a plan view of a carriage unit and the guide section illustrating a relationship between the carriage unit and the guide section when the carriage unit at a left end in apparatus width directions within a movement region of the carriage unit.
Figure 12:
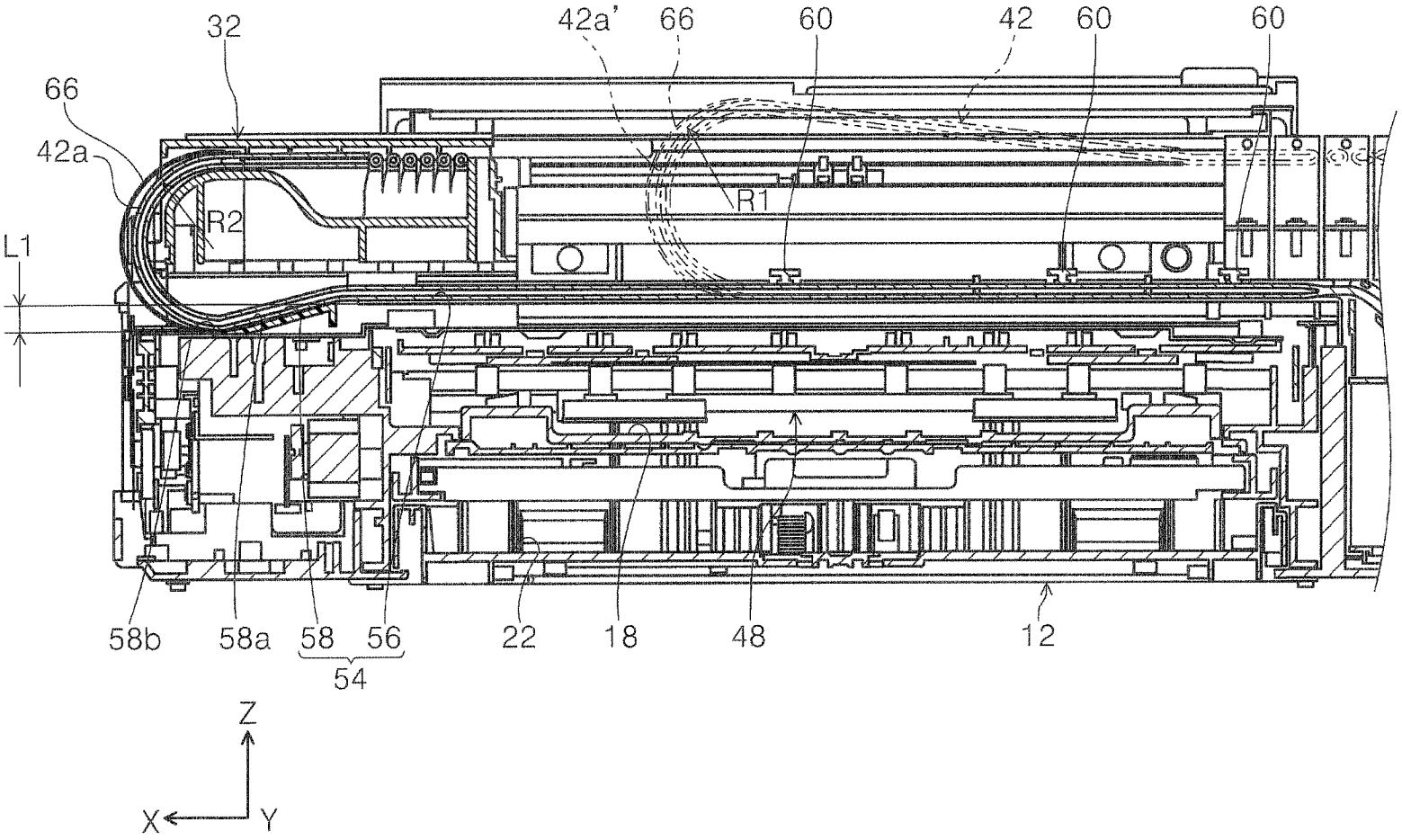
FIG. 12 is a sectional view of the apparatus body illustrating changes of a curved portion of an ink supply tube with movement of the carriage unit.
Figure 13:
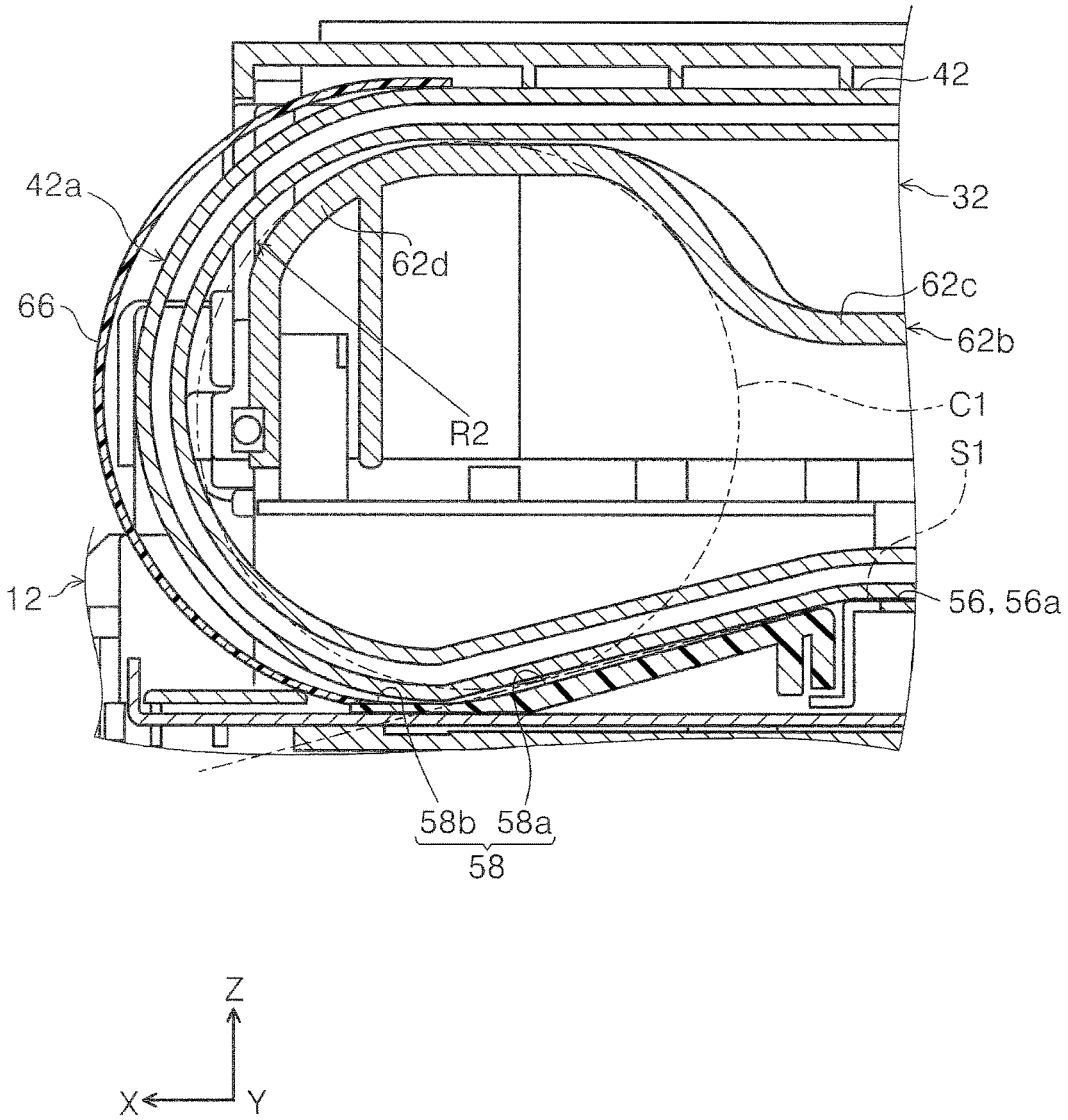
FIG. 13 is a sectional view of a curved guide portion of the carriage unit.

FIG. 8 is a perspective view of the ink tank section seen from the rear side in the apparatus depth directions. FIG. 9 is a perspective view of a guide section provided in the apparatus body. FIG. 10 is a perspective view of the guide section seen from the front side in the apparatus depth directions. FIG. 11 is a plan view of a carriage unit and the guide section illustrating a relationship between the carriage unit and the guide section when the carriage unit at a left end in apparatus width directions within a movement region of the carriage unit. FIG. 12 is a sectional view of the apparatus body illustrating changes of a curved portion of an ink supply tube with movement of the carriage unit. FIG. 13 is a sectional view of a curved guide portion of the carriage unit.

Figure 14:
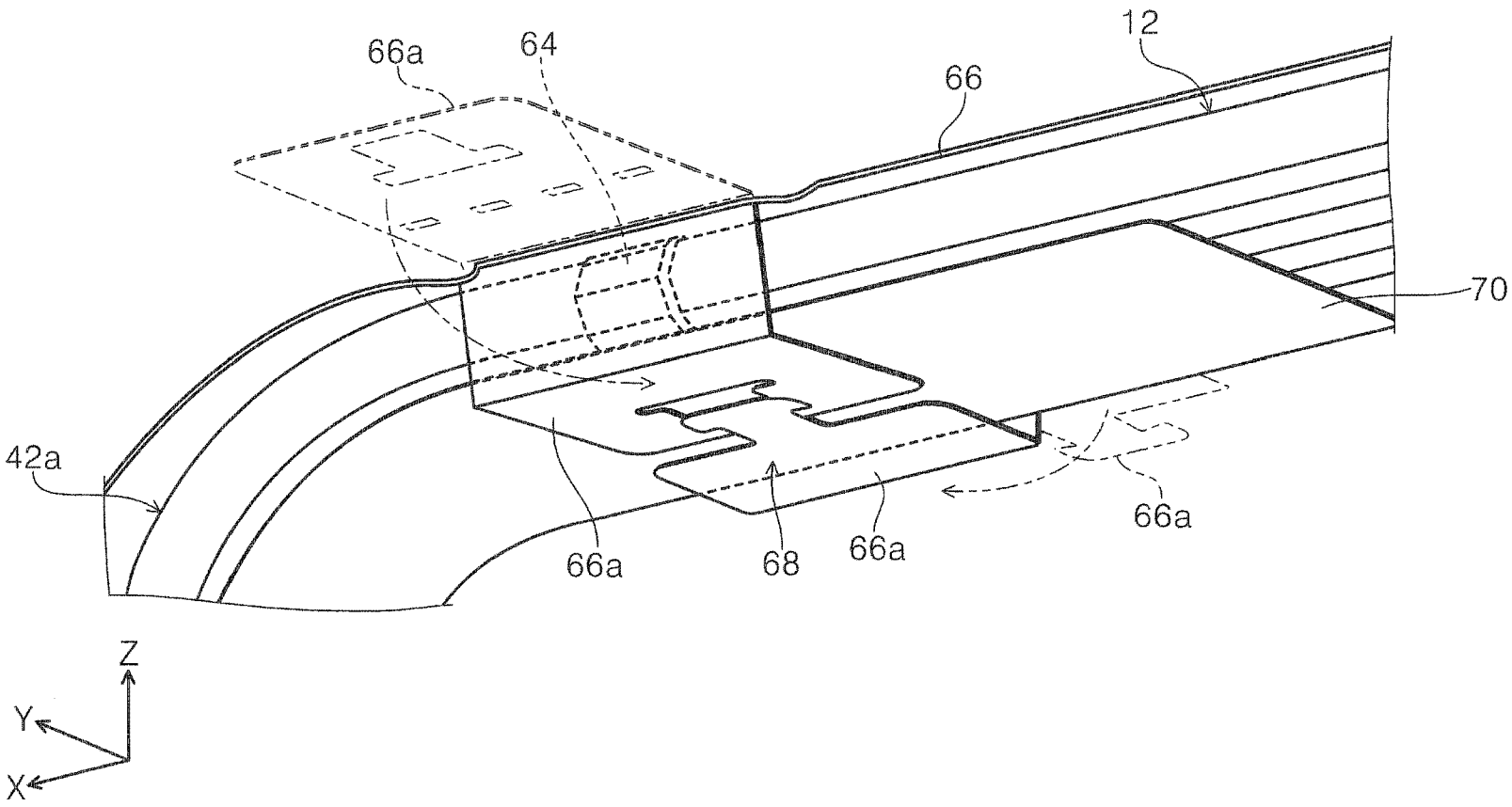
FIG. 14 is a perspective view of an ink supply tube, a first protective member, a second protective member, an enclosing portion.
Figure 15:
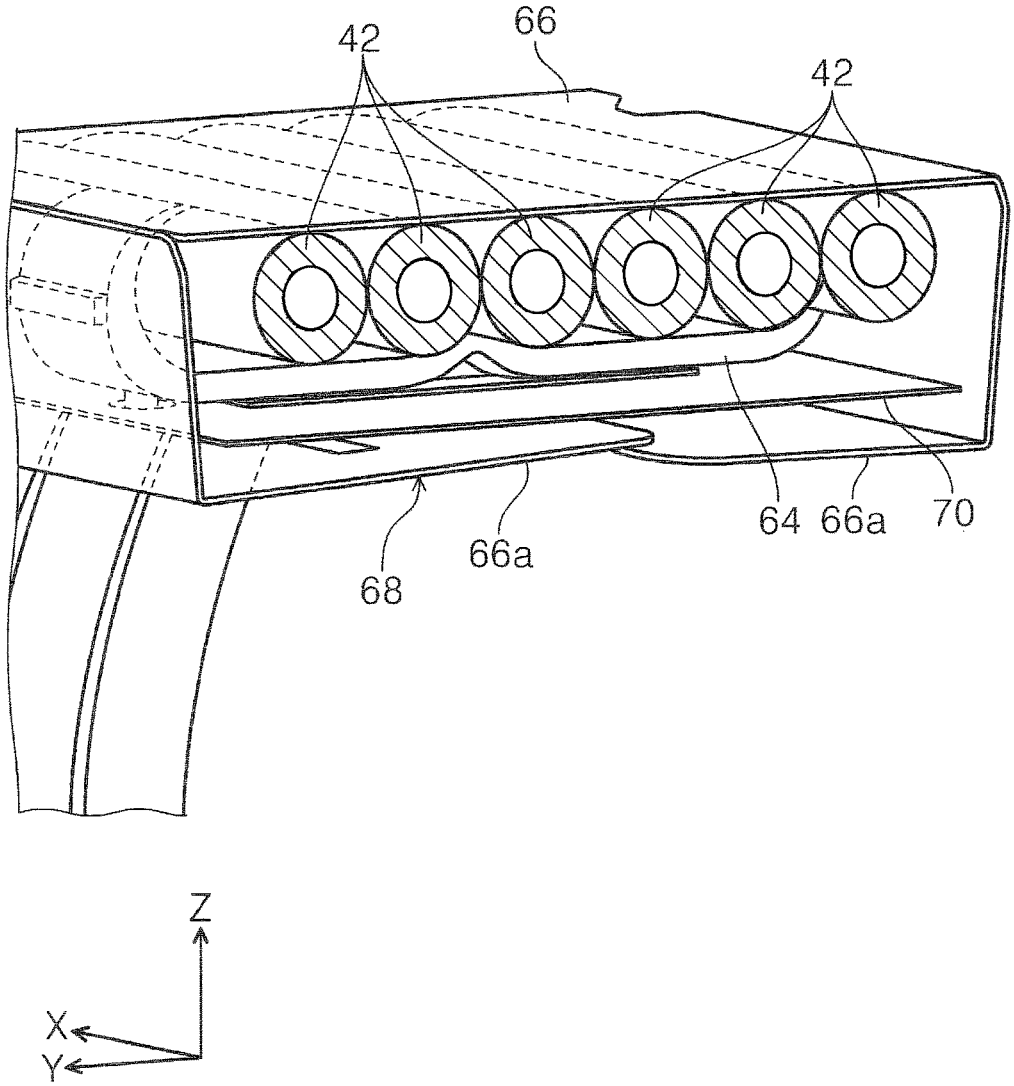
FIG. 15 is a perspective view of an enclosing portion of the ink supply tube.
Figure 16:
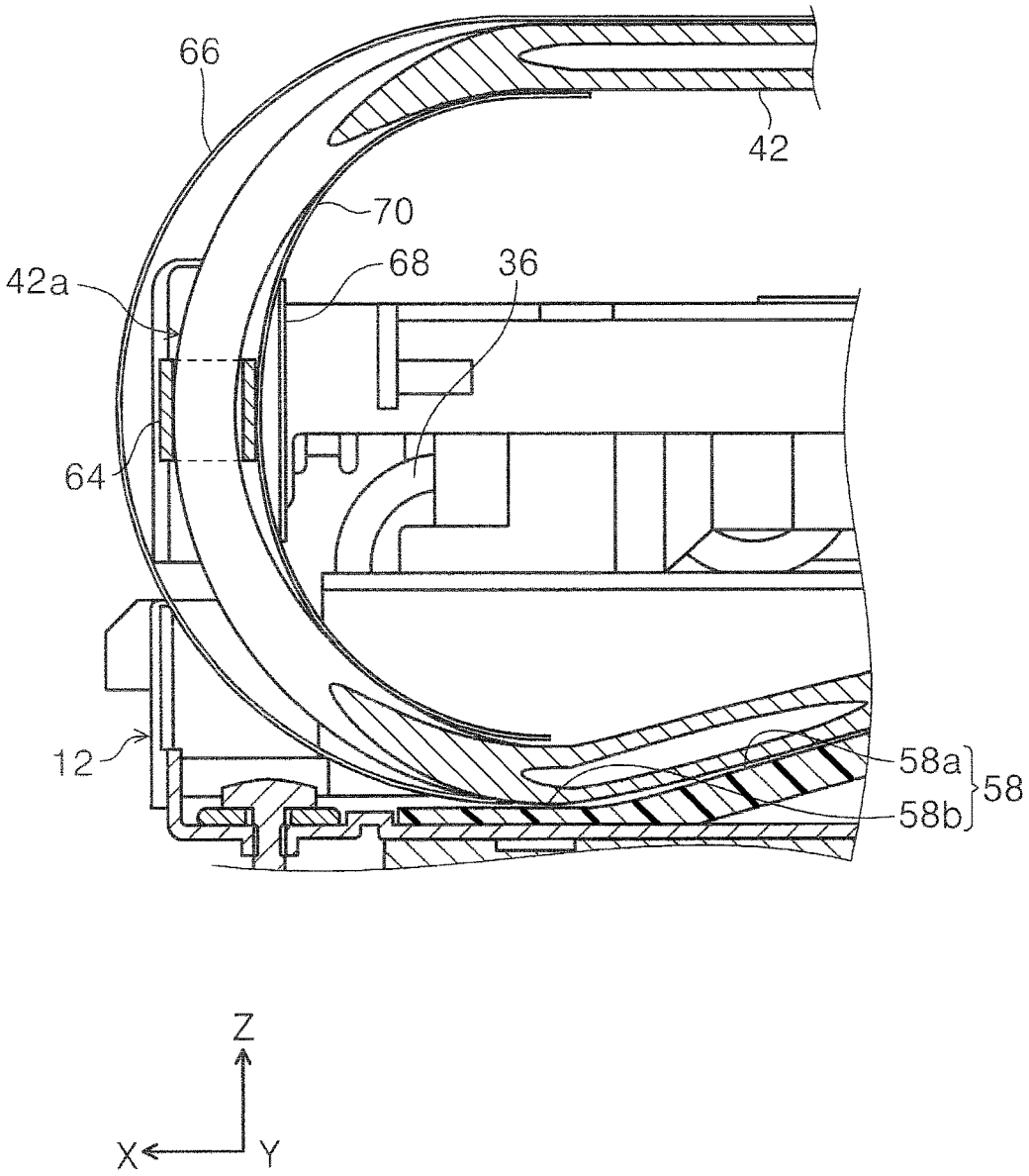
FIG. 16 is a side view of the curved portion of the ink supply tube.
Figure 17:
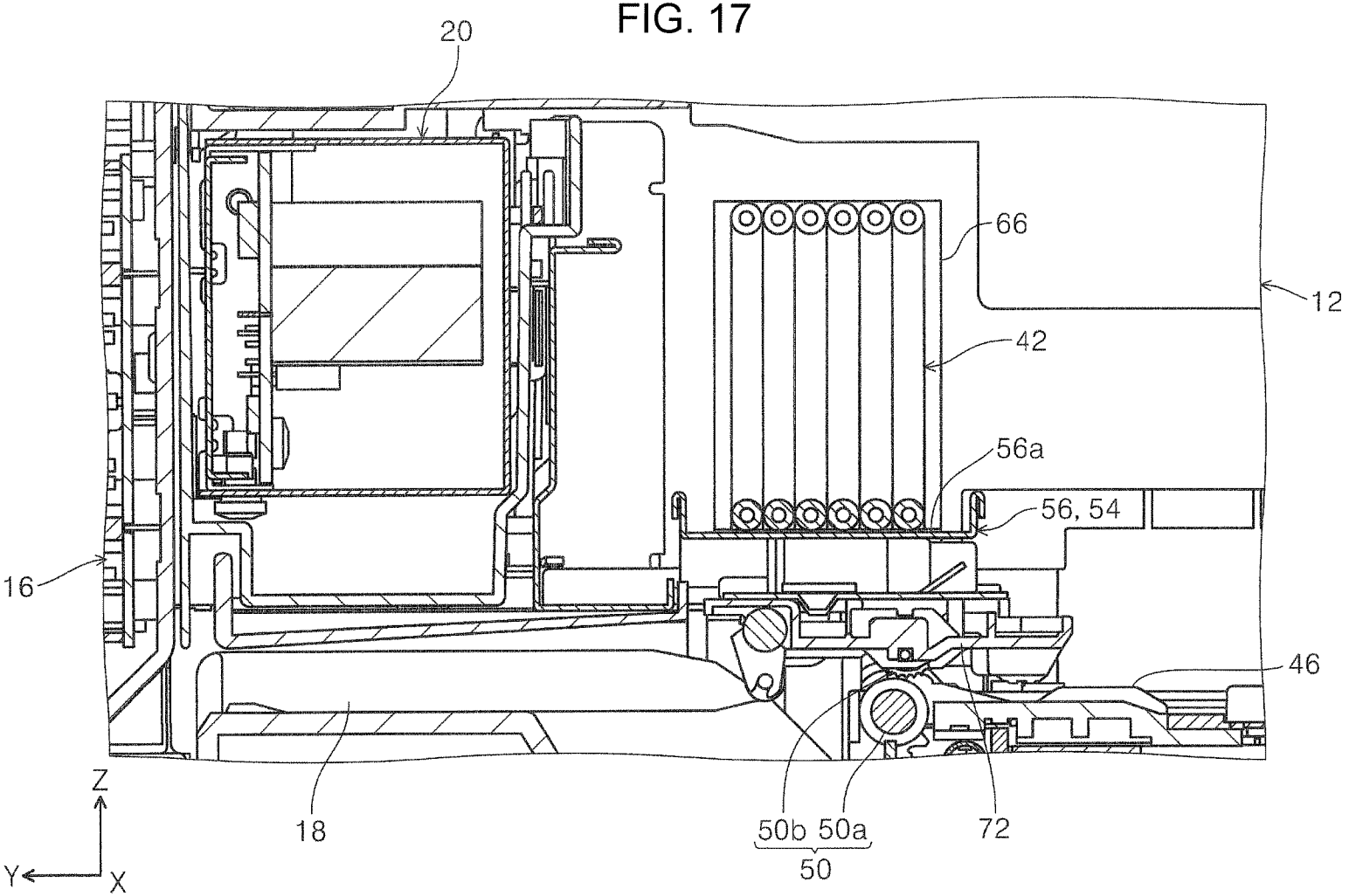
FIG. 17 is a side view of a medium discharge roller pair in a state in which a driven discharge roller supported on a roller support frame is in contact with a driving discharge roller.
Figure 18:
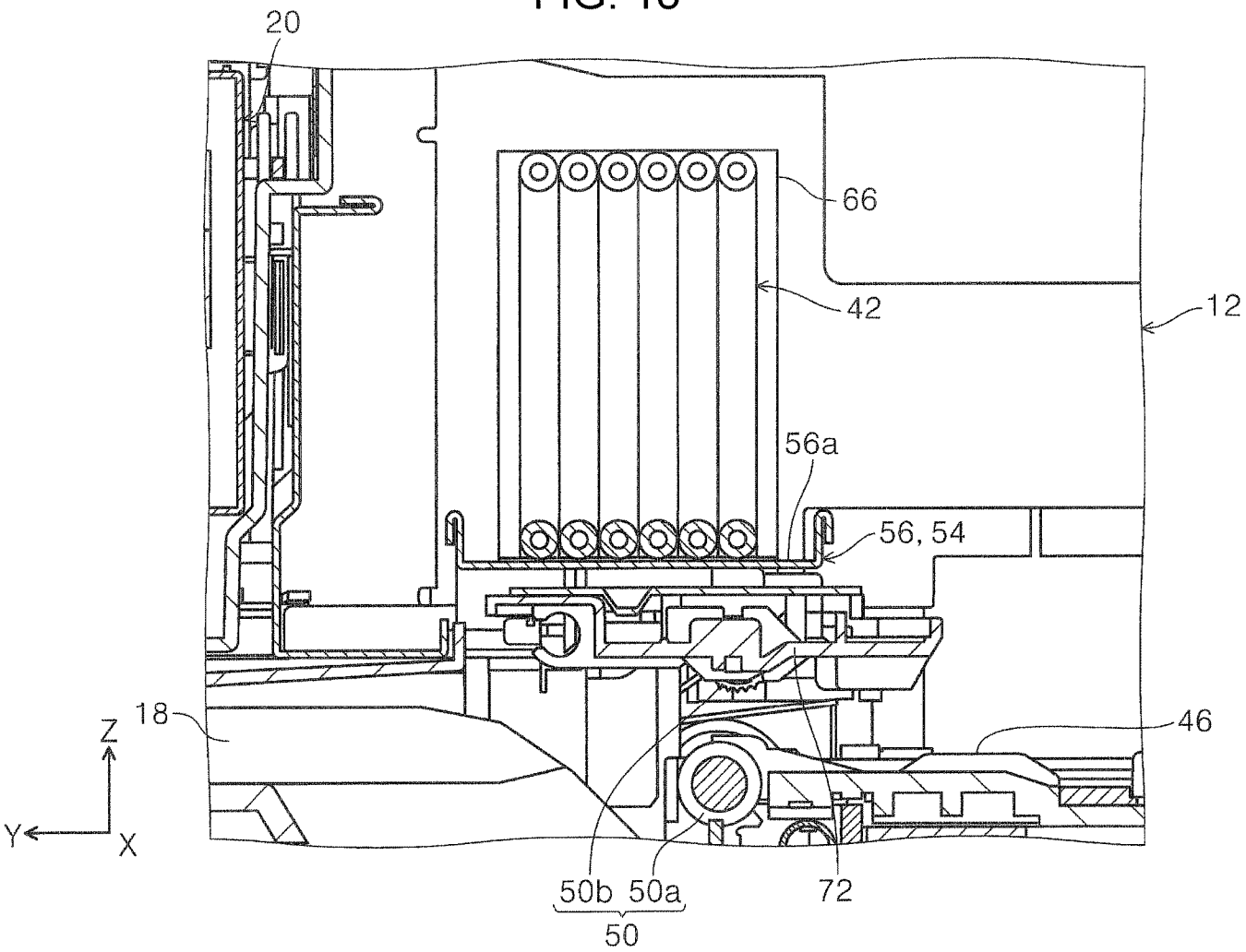
FIG. 18 is a side view of the medium discharge roller pair in which the driven discharge roller supported on the roller support frame is apart from the driving discharge roller.
Figure 19:
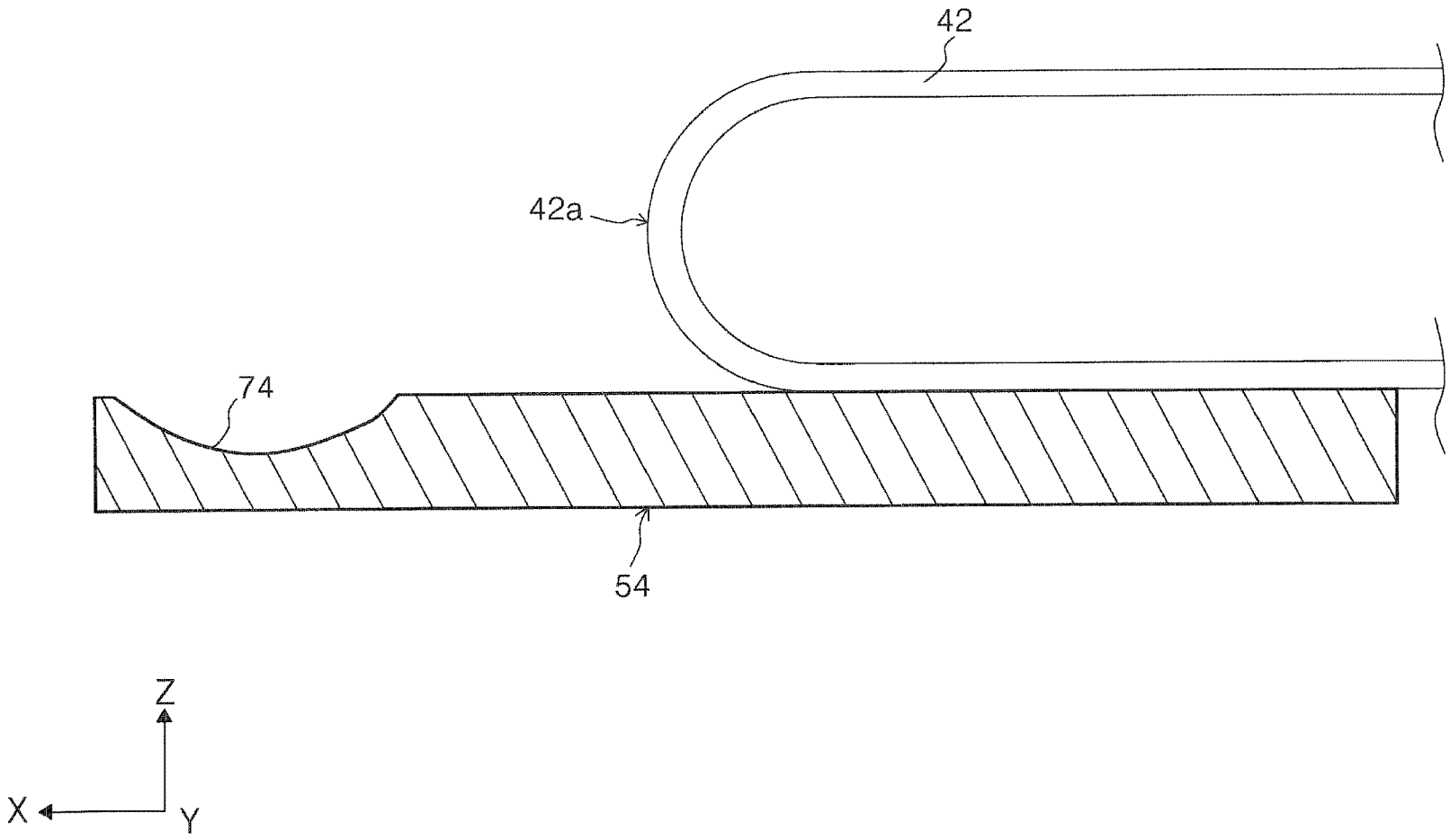
FIG. 19 is a side sectional view illustrating a modification of the guide section.
Figure 20:
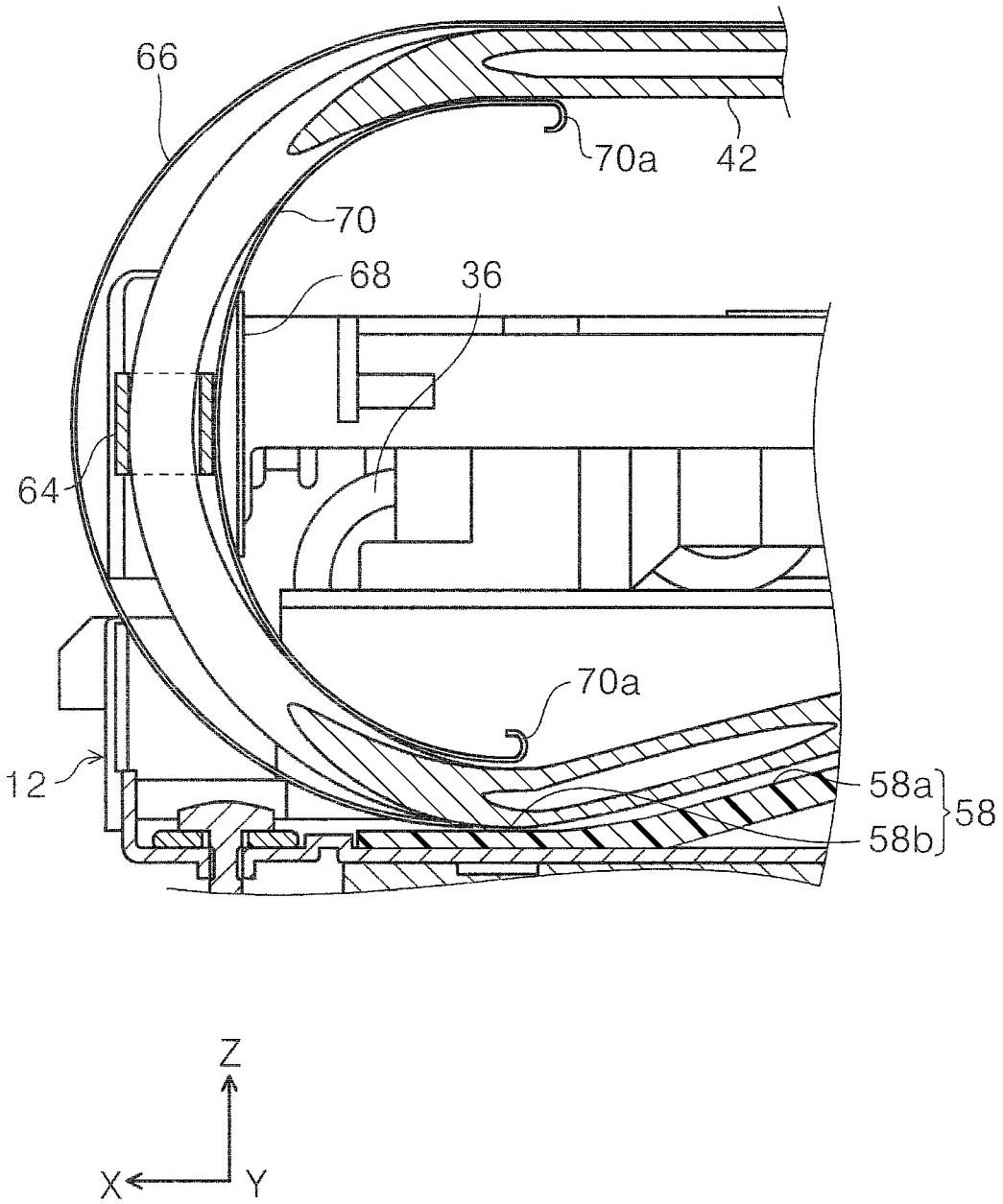
FIG. 20 is a side view of the curved portion of the ink supply tube illustrating a modification of the second protective member.

FIG. 14 is a perspective view of an ink supply tube, a first protective member, a second protective member, an enclosing portion. FIG. 15 is a perspective view of an encircled portion of the ink supply tube. FIG. 16 is a side view of the curved portion of the ink supply tube. FIG. 17 is a side view of a medium discharge roller pair in a state in which a driven discharge roller supported on a roller support frame is in contact with a driving discharge roller. FIG. 18 is a side view of the medium discharge roller pair in which the driven discharge roller supported on the roller support frame is apart from the driving discharge roller. FIG. 19 is a side sectional view illustrating a modification of the guide section. FIG. 20 is a side view of the curved portion of the ink supply tube illustrating a modification of the second protective member.

Figure 21:
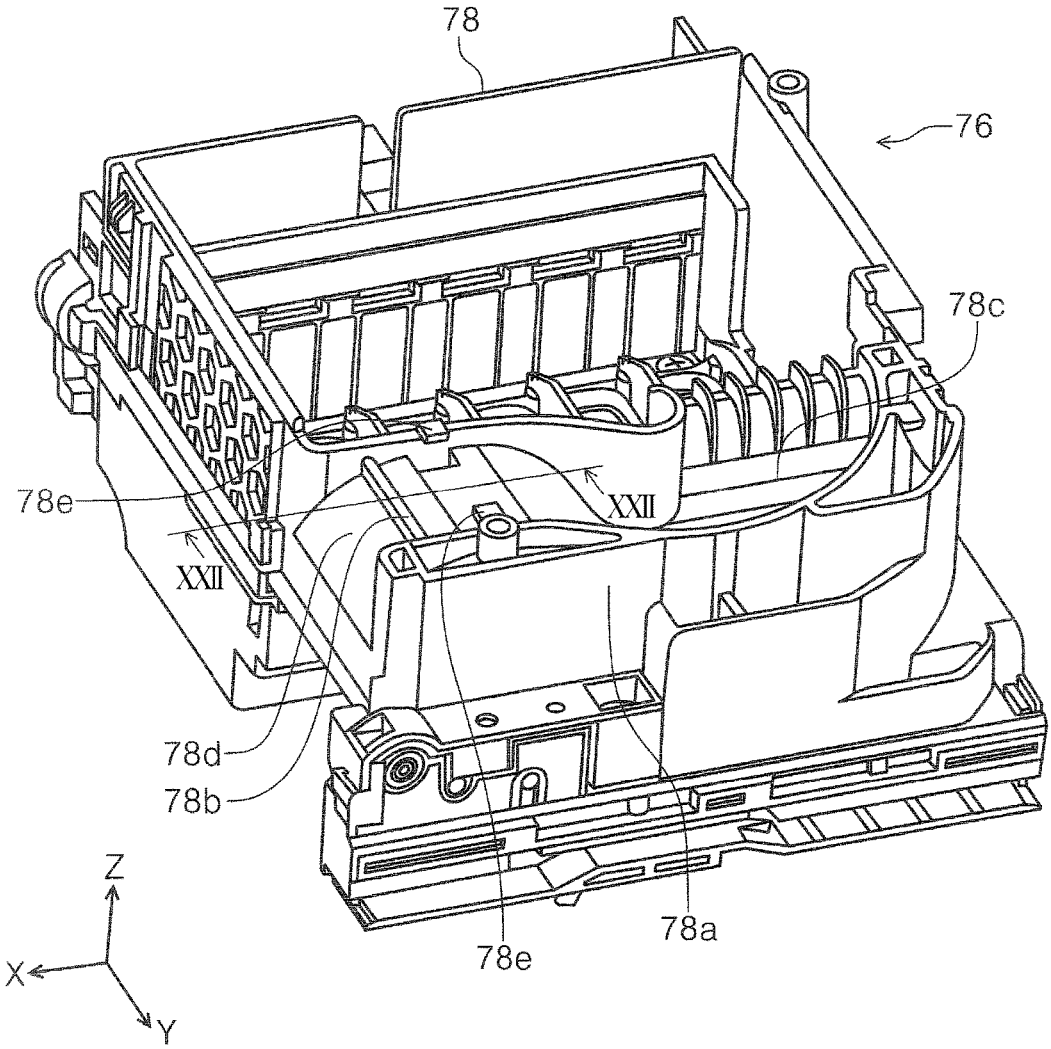
FIG. 21 is a perspective view of a casing of a carriage unit according to a second exemplary embodiment of the invention.
Figure 22:
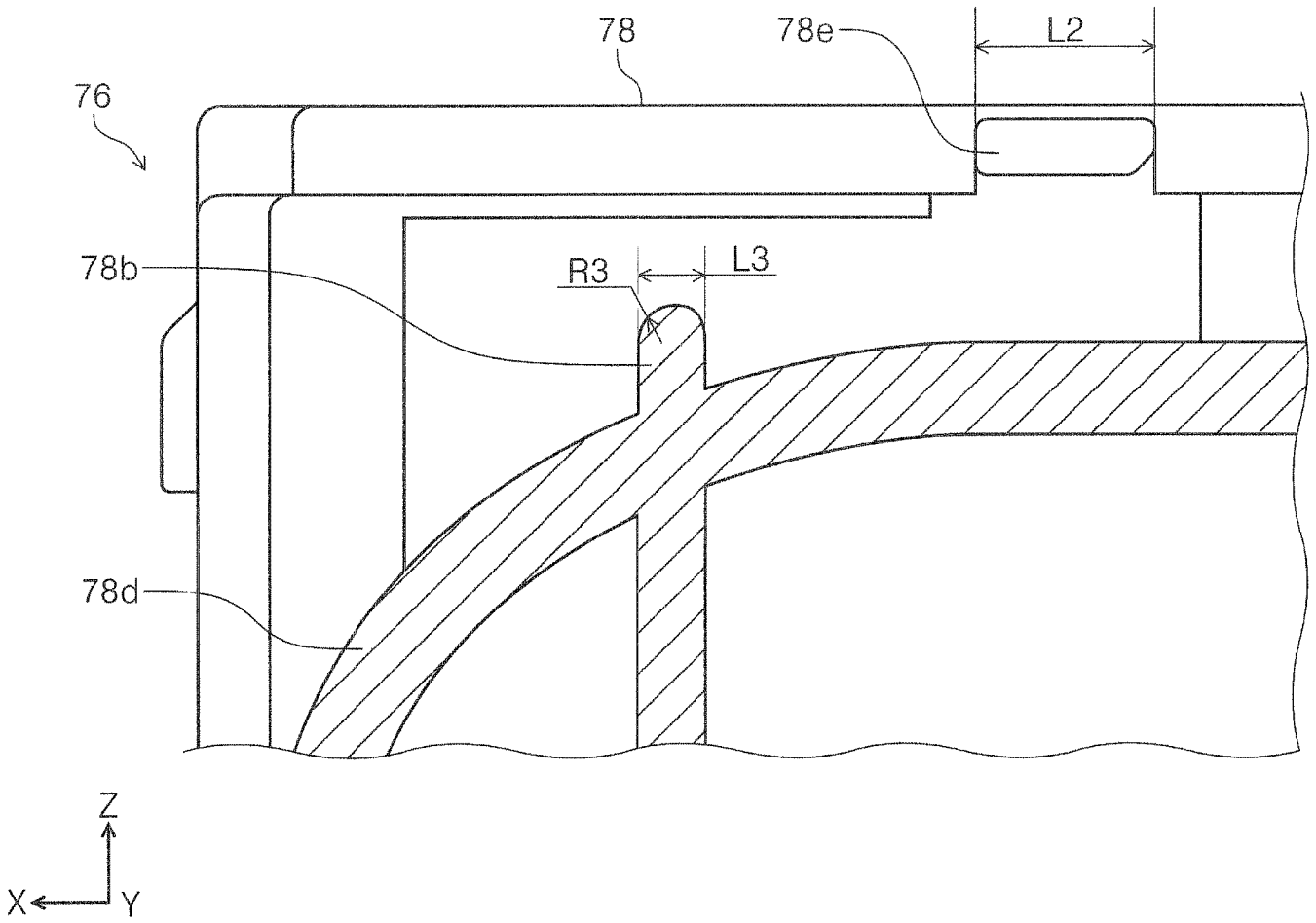
FIG. 22 is a sectional view taken along line XXII-XXII in FIG. 21.
Figure 23:
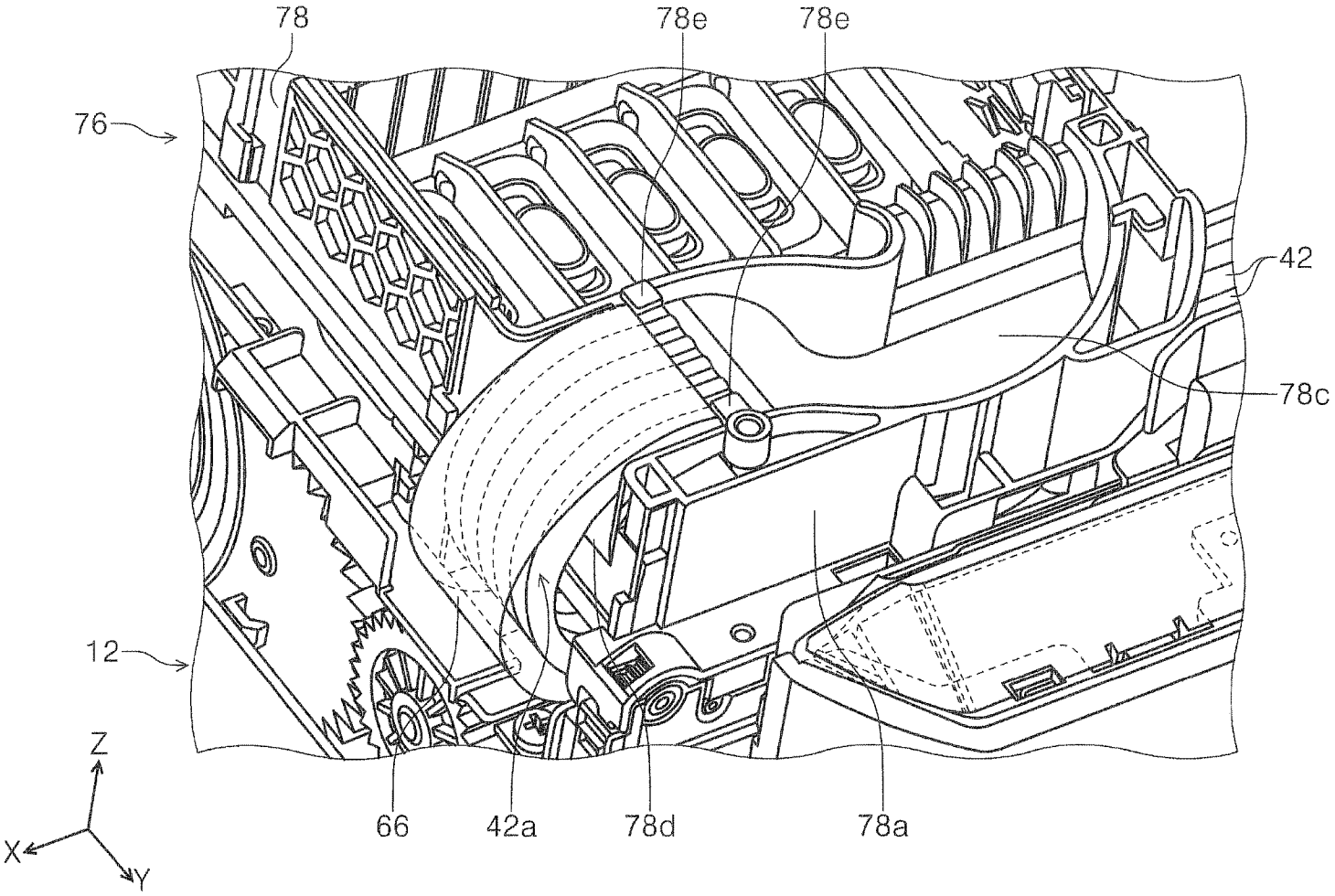
FIG. 23 is a perspective view illustrating a posture of the ink supply tube when the carriage unit is positioned at the left end in the apparatus width directions within the movement region of the carriage unit.
Figure 24:
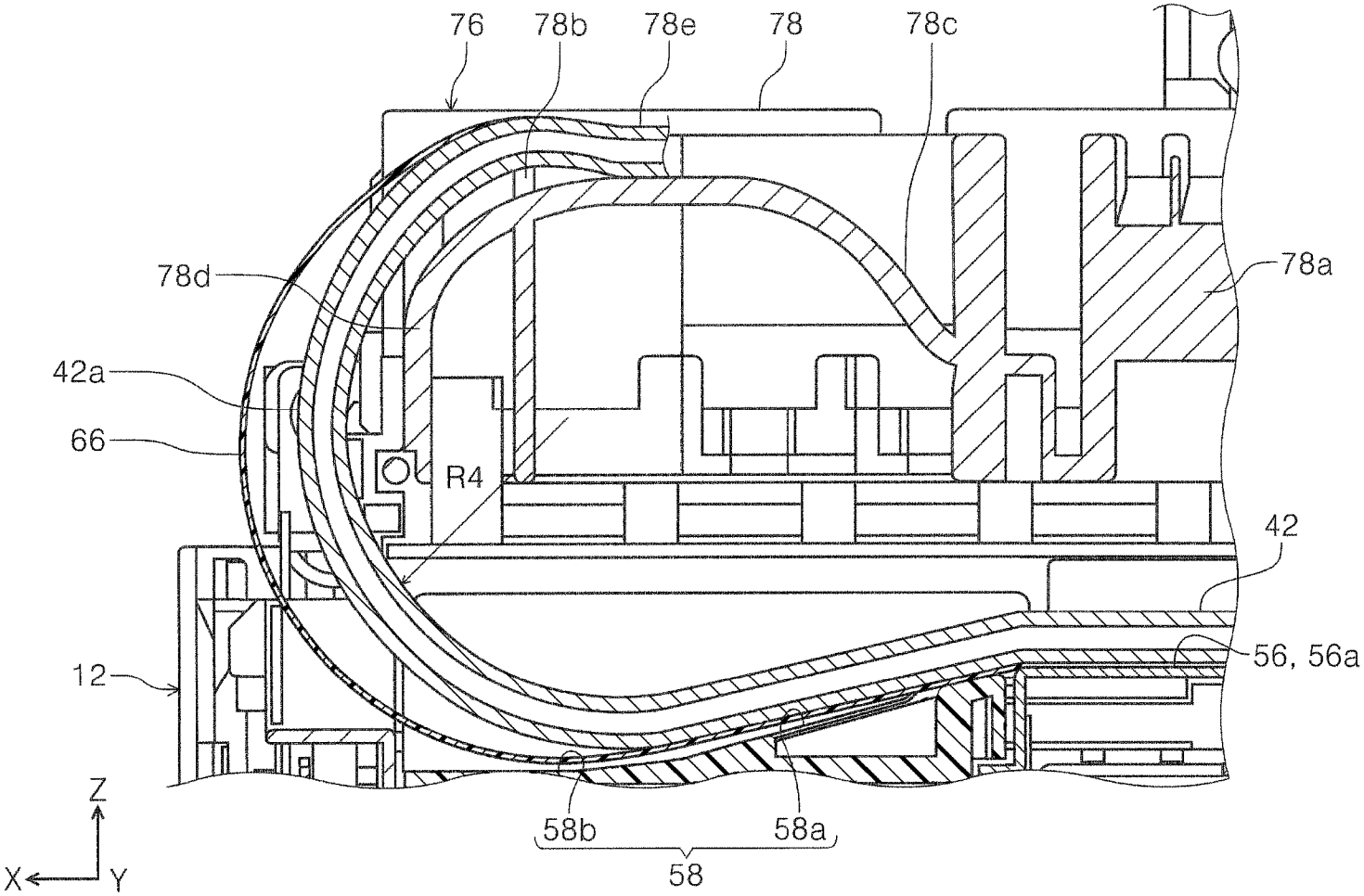
FIG. 24 is a side sectional view illustrating a posture of the ink supply tube when the carriage unit is positioned at the left end in the apparatus width directions within the movement region of the carriage unit.

FIG. 21 is a perspective view of a casing of a carriage unit according to a second exemplary embodiment of the invention. FIG. 22 is a sectional view taken along line XXII-XXII in FIG. 21. FIG. 23 is a perspective view illustrating a posture of the ink supply tube when the carriage unit is positioned at the left end in the apparatus width directions within the movement region of the carriage unit. FIG. 24 is a side sectional view illustrating a posture of the ink supply tube when the carriage unit is positioned at the left end in the apparatus width directions within the movement region of the carriage unit.

Figure 25:
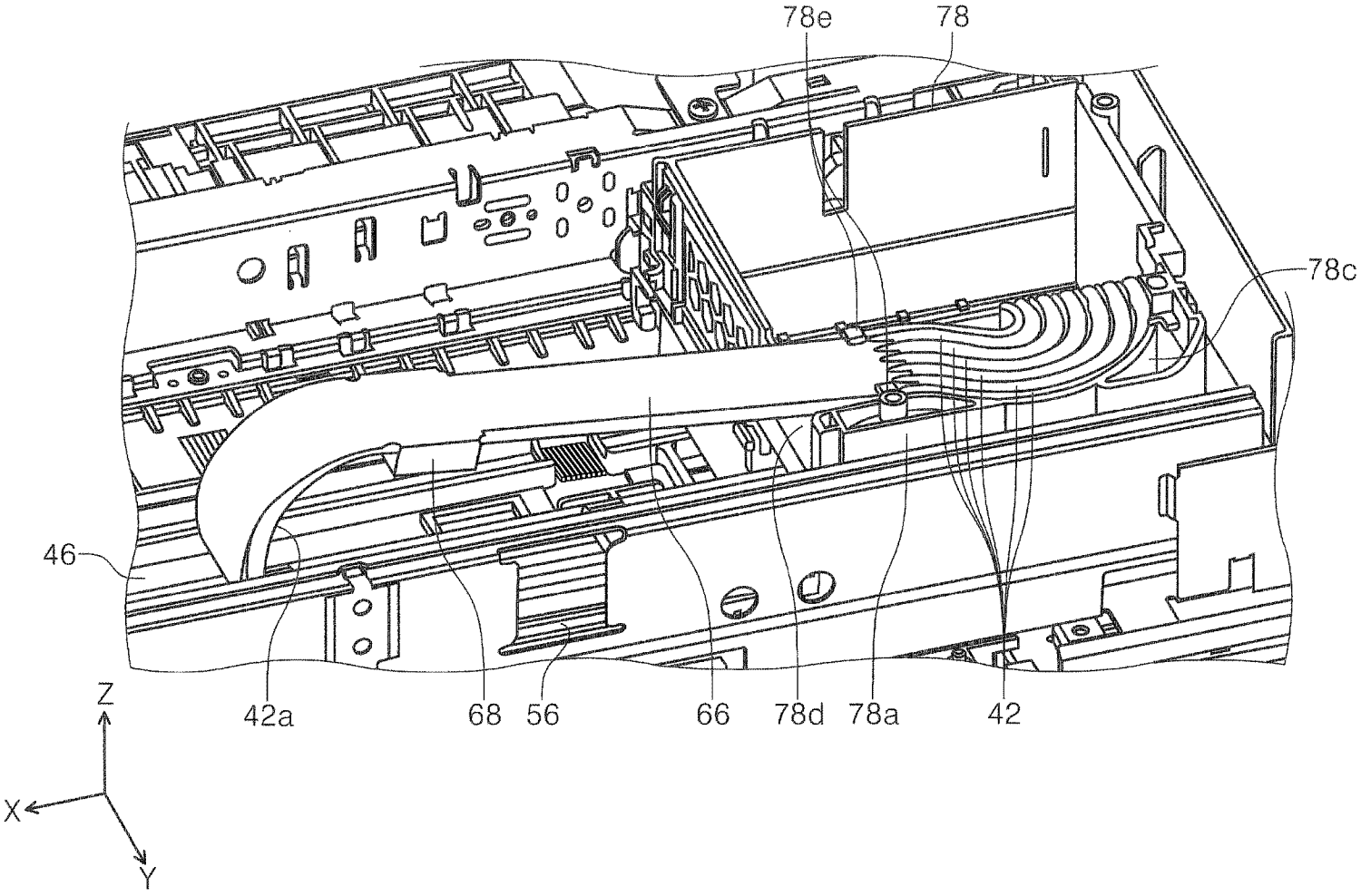
FIG. 25 is a perspective view illustrating a posture of the ink supply tube when the carriage unit is positioned at a right end in the apparatus width directions within the movement region of the carriage unit.
Figure 26:
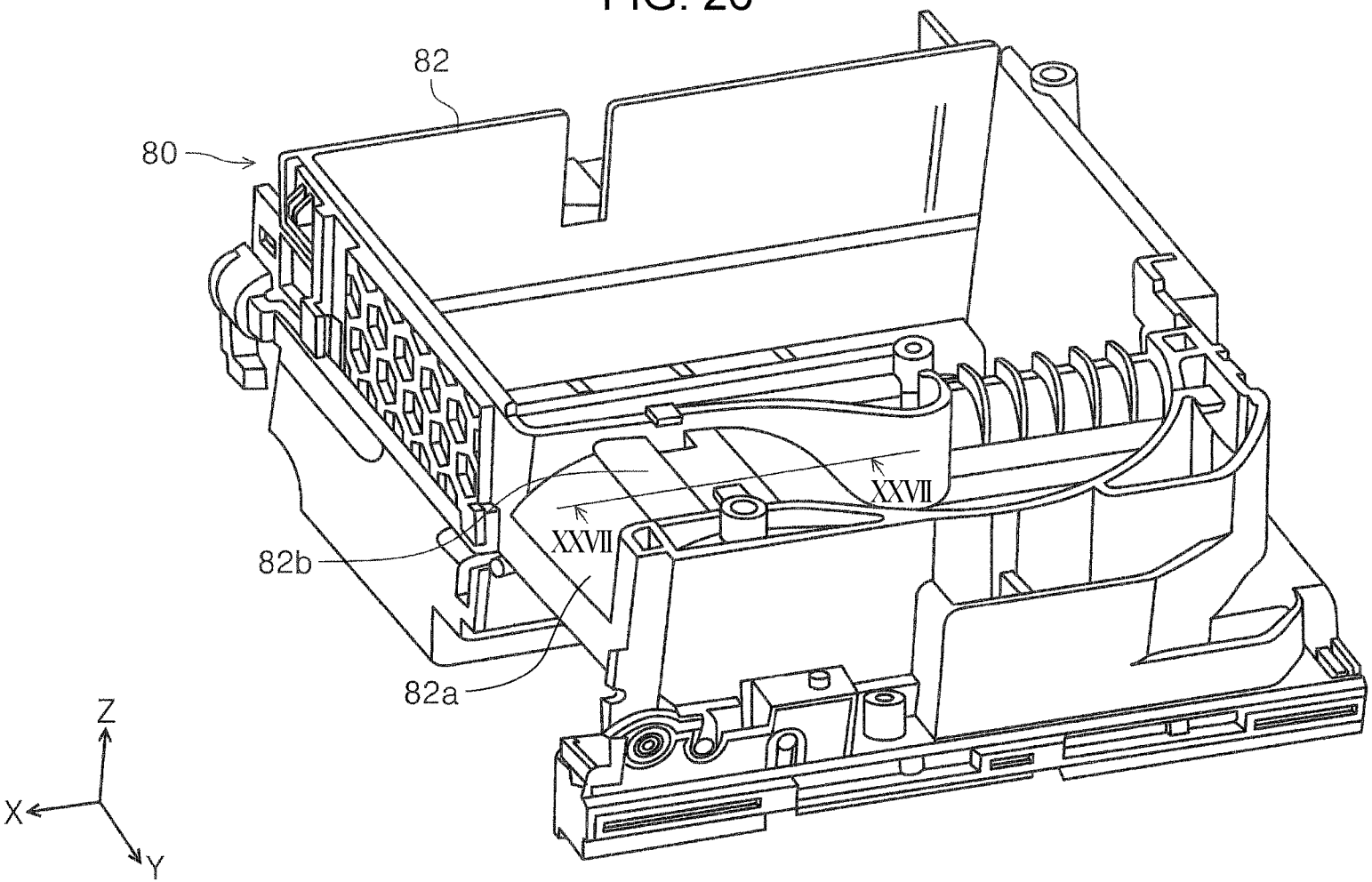
FIG. 26 is a perspective view illustrating a modification of the casing of the carriage unit according to the second exemplary embodiment.
Figure 27:
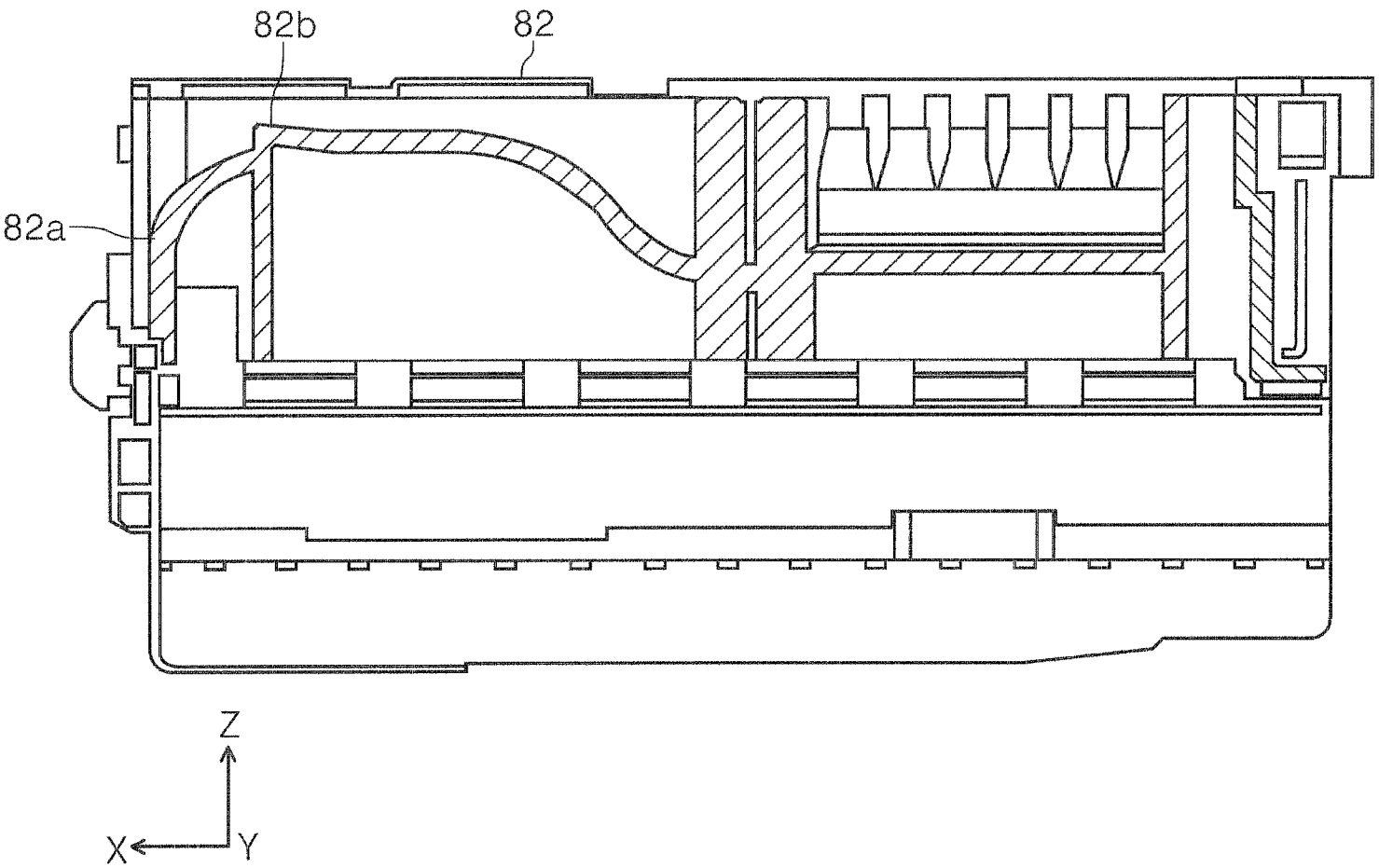
FIG. 27 is a sectional view taken along line XXVII-XXVII in FIG. 26.
Figure 28:
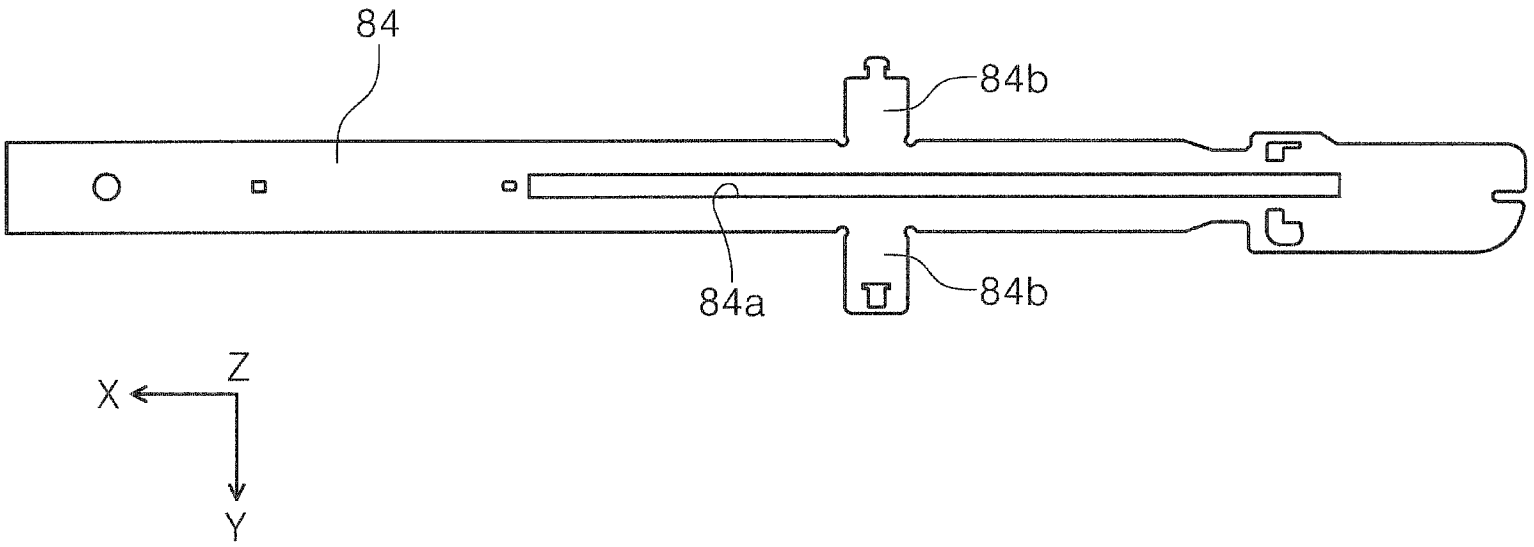
FIG. 28 is a plan view illustrating a modification of the first protective member.
Figure 29:
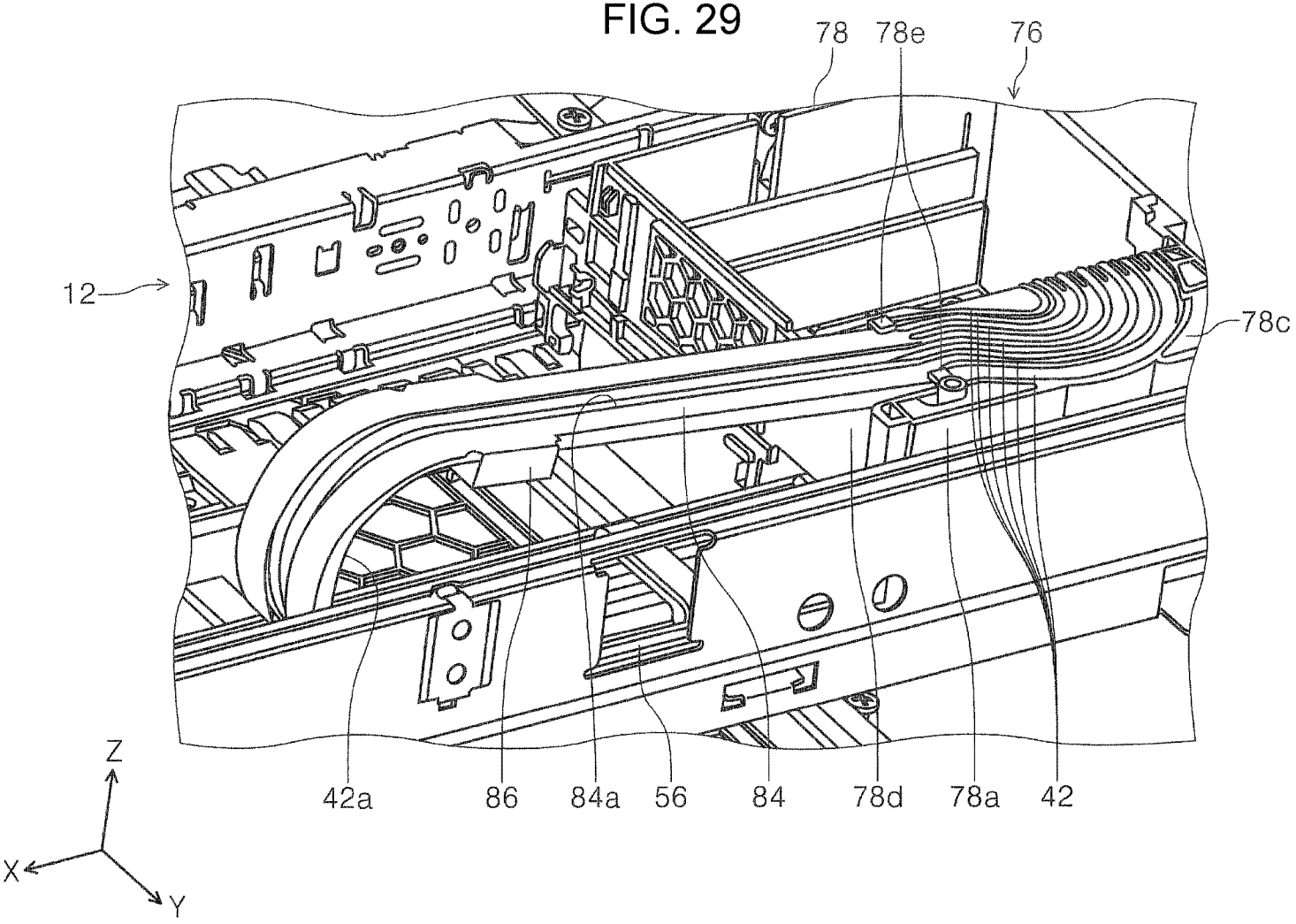
FIG. 29 is a perspective view illustrating a modification of the first protective member attached to the ink supply tube.
Figure 30:
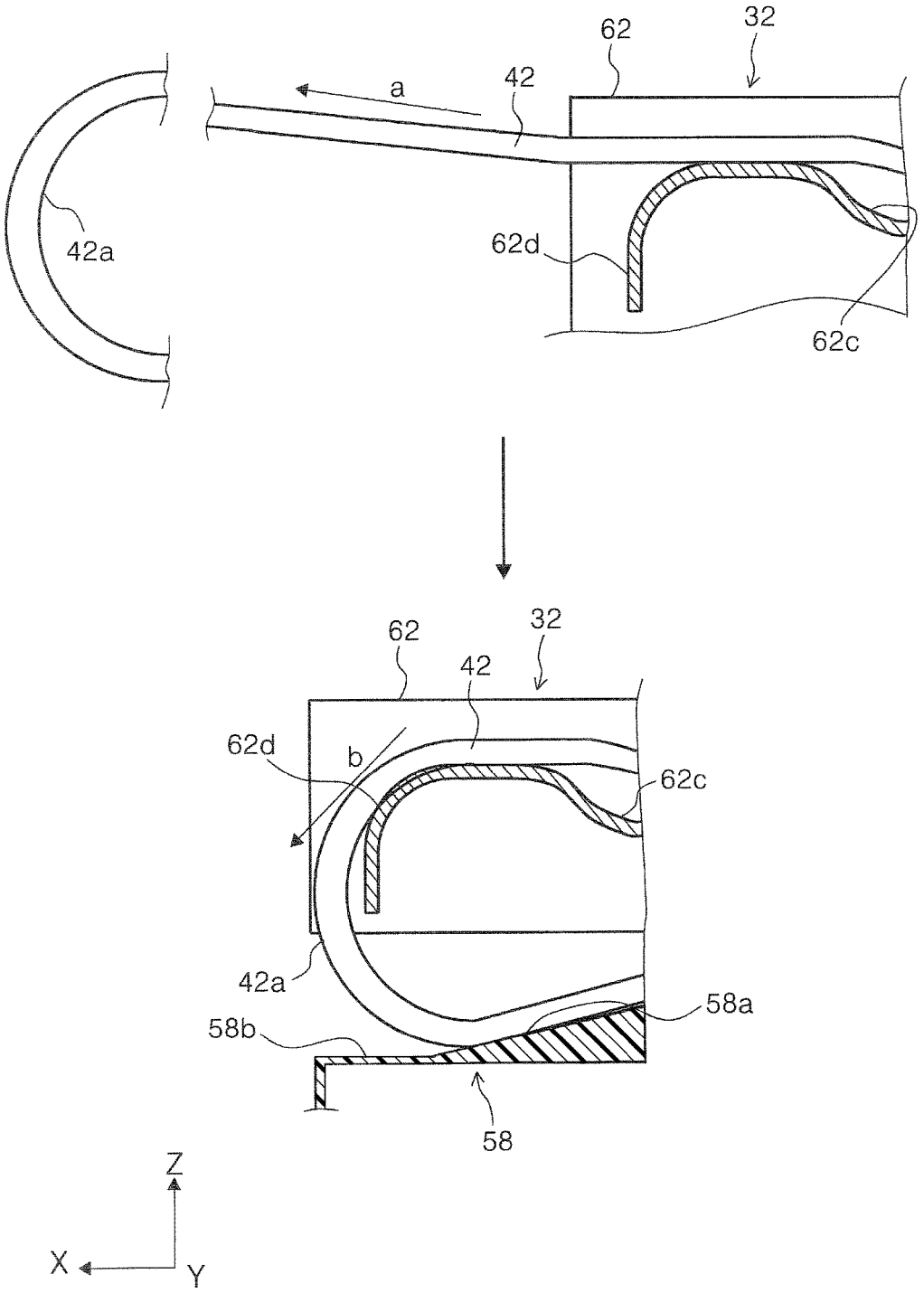
FIG. 30 is a diagram illustrating orientation of the ink supply tube extending from the carriage.

FIG. 25 is a perspective view illustrating a posture of the ink supply tube when the carriage unit is positioned at a right end in the apparatus width directions within the movement region of the carriage unit. FIG. 26 is a perspective view illustrating a modification of the casing of the carriage unit according to the second exemplary embodiment. FIG. 27 is a sectional view taken along line XXVII-XXVII in FIG. 26. FIG. 28 is a plan view illustrating a modification of the first protective member. FIG. 29 is a perspective view illustrating a modification of the first protective member attached to the ink supply tube. FIG. 30 is a diagram illustrating orientation of the ink supply tube extending from the carriage.

In an XYZ coordinate system indicated in the drawings, an X direction is a main scanning directions (moving direction) of the carriage, that is, a width directions of the recording apparatus (printer), a Y direction is a depth directions of the recording apparatus, and a Z direction is apparatus height directions. Furthermore, in the drawings, a positive X direction side is a leftward side in the apparatus width directions as a "second direction", the negative X direction side is a right side in the apparatus width directions as a "first direction", a positive Y direction is an apparatus front side, the negative Y direction side is an apparatus rear side, a positive Z direction side is an apparatus upper side, and the negative Z direction side is an apparatus lower side.

First Exemplary Embodiment

General Description of Printer

With reference to FIGS. 1 to 6, a printer 10 as an example of a "liquid ejecting apparatus" will be described. The printer 10 includes an apparatus body 12 and as a scanner 14 as an "opening/closing body" that is disposed on an upper portion of the apparatus body 12 so as to be pivotable relative to the apparatus body 12.

A front side of the apparatus body 12 in the apparatus depth directions is provided with an operation panel 16. The operation panel 16 is provided with a display unit, such as a liquid crystal panel, and an input unit that includes input buttons, switches, etc., as illustrated in FIGS. 1 to 4. The operation panel 16 is attached to the apparatus body 12 so as to be pivotable to a front side in the apparatus depth directions as illustrated in FIG. 2.

As illustrated in FIG. 2, when the operation panel 16 has been pivoted to the front side in the apparatus depth directions relative to the apparatus body 12, a medium discharge tray 18 disposed within the apparatus body 12 is exposed. The medium discharge tray 18 is configured to be movable between a position at which the medium discharge tray 18 is retracted within the apparatus body 12 (as indicated by solid lines in FIG. 2) and a position at which the medium discharge tray 18 is drawn out from the apparatus body 12 to the front side in the apparatus depth directions (as indicated by two-dot chain lines in FIG. 2).

Referring to FIGS. 4 and 5, behind the operation panel 16 in the apparatus depth directions there is disposed an electric power supply portion 20 extending in apparatus width directions. The electric power supply portion 20 supplies electric power to driving elements in the printer 10. The electric power supply portion 20 also supplies electric power to a control portion (not depicted) provided inside the apparatus body 12.

At a lower side of the medium discharge tray 18 in the apparatus height directions inside the apparatus body 12 there is a medium housing portion 22 capable of housing media (e.g., sheets of paper or the like). The medium housing portion 22 is attached so as to be capable of being pulled out of and inserted into the apparatus body 12 via a front side surface of the apparatus body 12 in the apparatus depth directions.

Referring to FIG. 3, the scanner 14 is pivotable relative to the apparatus body 12 about a pivotal point defined at a rear side in the apparatus depth directions. The scanner 14 can be switched between a closed posture relative to the apparatus body 12 (see FIGS. 1 and 2) and an open posture relative the apparatus body 12 (see FIG. 3). In this exemplary embodiment, the scanner 14 is disposed at an upper side of a carriage unit 32 (76 and 80) described later in the apparatus height directions. By switching the scanner 14 between the closed posture and the open posture, a movement region of the carriage unit 32 (76 and 80) can be opened and closed.

As illustrated in FIGS. 1 to 4, an ink tank section 24 is provided at the front side of the apparatus body 12 in the apparatus depth directions, more specifically, the front side of a right end portion of the apparatus body 12 in apparatus width directions. The ink tank section 24 includes a plurality of ink tanks 26 as "liquid storing containers" (see FIG. 8), a casing 28 that covers the ink tanks 26, and a cover 30 pivotably attached to the casing 28.

The ink tank section 24 is disposed so that at least a portion of the ink tank section 24 in the apparatus width directions is positioned below the scanner 14 in the closed posture. In this exemplary embodiment, five ink tanks 26 are provided as illustrated in FIG. 8. Concretely, the five ink tanks 26 are ink tanks 26A, 26B, 26C, 26D and 26E. The ink tanks 26A, 26B, 26C, 26D and 26E contain a black ink, a magenta ink, a yellow ink, a cyan ink, and a photoblack ink, respectively, as examples of "liquids". The ink tank 26A has a larger ink capacity than the other ink tanks 26B, 26C, 26D and 26E. At the front side of the ink tank section 24 in the apparatus depth directions there is provided a display unit 24*a* that allows the remaining amounts of the inks in the ink tanks 26 to be checked.

When the scanner 14 assumes the open posture relative to the apparatus body 12, the cover 30, which is provided on an upper portion of the casing 28 of the ink tank section 24 and covers upper portions of the ink tanks 26, is completely exposed. The cover 30 is attached pivotably to the casing 28. When the cover 30 is completely exposed as mentioned above, the cover 30 can be pivoted relative to the casing 28 so that the upper portions of the ink tanks 26 are exposed as illustrated in FIG. 3. A configuration of the ink tanks 26 will be described later.

Next, referring to FIG. 4 and FIG. 5, a carriage unit 32 is disposed at the rear side of the ink tank section 24 in the apparatus depth directions. For example, the carriage unit 32 is configured to be movable back and forth in the apparatus width directions within the apparatus body 12. Note that FIG. 4 depicts, as an example, a state in which the carriage unit 32 is positioned at a home position. More concretely, the carriage unit 32 is provided with a drive mechanism that includes a driving motor 34 provided at the rear side of the carriage unit 32 in the apparatus depth directions.

A driving shaft of the driving motor 34 is provided with a driving pulley that is not depicted. Spaced from the driving pulley (not depicted) in the apparatus width directions, a driven pulley 36 (see FIG. 4) is provided in the apparatus body 12 so as to be passively rotated by the driving pulley. The driving pulley (not depicted) and the driven pulley 36 are connected by an endless belt 38 (see FIG. 4) wrapped around the driving and driven pulleys. At least a portion of the endless belt 38 is firmly attached to the carriage unit 32 by a gripper (not depicted) provided on a rear end portion of the carriage unit 32. When the driving motor 34 is rotationally driven, the endless belt 38 is rotated in the same direction as the driving motor 34 is rotated, so that the carriage unit 32 is moved in the apparatus width directions. As an example, the home position of the carriage unit 32 is set at the position of the carriage unit 32 in the apparatus body 12 illustrated in FIG. 4.

Relay adapters 40 are attached to the carriage unit 32 as illustrated in FIG. 4. The relay adapters 40 are connected to the ink tanks 26 via ink supply tubes 42.

As illustrated in FIG. 6, a recording head 44 as a "liquid ejecting head" is provided in a lower portion of the carriage unit 32. A lower surface of the recording head 44 is configured as a nozzle surface in which nozzles for ejecting the inks have openings. Note that although not depicted in the drawings, for example, the nozzles are arranged along the apparatus depth directions so as to form nozzle rows. Furthermore, the relay adapters 40 are configured to allow the inks to be supplied to the nozzles of the recording head 44.

As illustrated in FIG. 4, below the recording head 44 there is provided a medium support member 46 extending in the apparatus width directions. A transport roller pair 48 is provided at the rear side of the medium support member 46 in the apparatus depth directions.

Furthermore, referring to FIG. 17, a medium discharge roller pair 50 is provided at the front side of the medium support member 46 in the apparatus depth directions. The medium discharge roller pair 50 is made up of a driving discharge roller 50*a* that is rotationally driven by a drive source (not depicted) and a driven discharge roller 50*b* that contacts the driving discharge roller 50*a* and is passively rotated.

A recording operation that the printer 10 performs on the medium will be described. The medium housed in the medium housing portion 22 is fed to the transport roller pair 48 by a feeder (not depicted). Then, the transport roller pair 48 nips the medium and sends the medium into a region where the medium faces the recording head 44 from under the recording head 44. The medium supported by the medium support member 46 receives, on its surface facing the recording head 44, ink ejected from nozzles of the recording head 44. In this manner, recording is carried out on the surface of the medium that faces the recording head 44. After being subjected to recording, the medium is nipped by the medium discharge roller pair 50 and is discharged to the medium discharge tray 18 protruding forward in the apparatus depth directions of the apparatus body 12.

Ink Supply Path

An ink supply path in the printer 10 from the ink tanks 26 to the recording head 44 of the carriage unit 32 will be described with reference to FIG. 4 to FIG. 13. Referring to FIGS. 4, 5 and 8, an end of each of the ink supply tubes 42 is connected to a corresponding one of the relay adapters 40 provided on the carriage unit 32. The ink supply tubes 42 extending from the relay adapters 40 to the front side in the apparatus depth directions curve, at a location in front of the carriage unit 32 in the apparatus depth directions, toward a left side of the printer 10 in the apparatus width directions.

The ink supply tubes 42, after extending leftward in the apparatus width directions, curves to a lower side in the apparatus height directions to form a curved portion 42*a*. From the curved portion 42*a*, the ink supply tubes 42 extend back from left to right in the apparatus width directions. The ink supply tubes 42 extending rightward in the apparatus width directions are connected to the ink tanks 26 of the ink tank section 24 provided on the right end side of the apparatus body 12 in the apparatus width directions.

A configuration of surroundings of the ink tank section 24 will be described with reference to FIG. 8. Each ink tank 26 includes an ink storing portion 26*a* that, at a lower side in the apparatus height directions, extends in the apparatus depth directions (front/rear direction) and an ink pour portion 26*b* protruding upward from the ink storing portion 26*a* in the apparatus height directions. An upper portion of the ink pour portion 26*b* is provided with an ink pour port 26*d*. That is, the ink tanks 26 each have a stair shape when seen from the apparatus width directions.

The ink storing portion 26*a* of each ink tank 26 has, on its lower portion on the rear side in the apparatus depth directions, a connector portion 26*e*. The connector portion 26*e* is connected with the second end of a corresponding one of the ink supply tubes 42. Note that, as for the ink tank 26A, which contains the black ink, the second ends of two ink supply tubes 42 are connected. That is, one supply tube 42 is connected to the connector portion 26*e* of each of the ink tanks 26B, 26C, 26D and 26E and two supply tubes 42 are connected to the connector portion 26*e* of the ink tank 26A.

On top of ink storing portions 26*a* of the ink tanks 26 there is provided a tube guiding portion 52. The ink supply tubes 42 extending upward from the connector portions 26*e* in the apparatus height directions are curved by the tube guiding portion 52 toward the front side in the apparatus depth directions and then the leftward direction of the apparatus width directions.

Guide Section

A guide section 54 will be described with reference to FIGS. 9 to 11. The guide section 54 extending in the apparatus width directions is provided at the rear side of the operation panel 16 and the electric power supply portion 20 in the apparatus depth directions of the apparatus body 12. The guide section 54 is disposed at the left side of the tube guiding portion 52 of the ink tank section 24 in the apparatus width directions. The guide section 54 is located below the carriage unit 32 in the apparatus height directions. The guide section 54 includes a guide member 56 as a "first site" and a relieving portion 58 as a "second site".

The guide member 56 is, for example, located to the left of the tube guiding portion 52 in the apparatus width directions and adjacent to the tube guiding portion 52. The guide member 56 is provided as a flat platy member extending in the apparatus width directions. Furthermore, as illustrated in FIGS. 9 and 10, a front end portion and a rear end portion of the guide member 56 in the apparatus depth directions protrude upward in the apparatus height directions. That is, the guide member 56 has a recess-shaped (U-shaped) cross section along the apparatus depth directions. A recess portion of the guide member 56 functions as a guide surface 56*a* that guides the ink supply tubes 42. The guide member 56 is formed, for example, by bending a metal material by a bending process such as a press process.

Tube retaining members 60 are attached to the guide member 56, with intervals left therebetween in the apparatus width directions. The tube retaining members 60 extend in the apparatus depth directions across and above the guide surface 56*a*.

As illustrated in FIGS. 5 to 12, portions of the ink supply tubes 42 extending from the curved portion 42*a* toward the ink tanks 26 extend through spaces that are defined in the apparatus height directions by the tube retaining members 60 and the guide surface 56*a* of the guide member 56. Therefore, if the ink supply tubes 42 should tend to move away from the guide surface 56*a* as the carriage unit 32 moves in the apparatus width directions, the tube retaining member 60 will restrict the ink supply tubes 42 from being displaced in a direction away from the guide surface 56*a*.

The relieving portion 58, as illustrated in FIGS. 9 to 11, is disposed at the left side of the guide member 56 in the apparatus width directions. In this exemplary embodiment, the relieving portion 58 is disposed at the left side in the apparatus body 12 in the apparatus width directions. In FIG. 11, a two-dot chain line denoted by character W indicates a position of a left end portion of a medium transport region in the apparatus width directions. That is, in this exemplary embodiment, the relieving portion 58 is located outside the medium transport region in the apparatus width directions.

In FIG. 11, the carriage unit 32 is positioned at a left end portion of the movement region of the carriage unit 32 in the apparatus width directions, within the apparatus body 12. During this state, a boundary region between the guide member 56 and the relieving portion 58 of the guide section 54 is located at substantially a central portion of the recording head 44 (indicated by a one-dot chain line FIG. 11) of the carriage unit 32 in the apparatus width directions.

The relieving portion 58 has, for example, an inclined portion 58*a* that is inclined downward in the apparatus height directions as the inclined portion 58*a* extends from right to left in the apparatus width directions and a horizontal portion 58*b* connected to the inclined portion 58*a* and extending leftward in the apparatus width directions. Then, the relieving portion 58 is, for example, formed from a resin material or the like that is lower in rigidity than a metal material. That is, in this exemplary embodiment, the relieving portion 58 is provided as a member that is lower in rigidity than the guide member 56.

Furthermore, as illustrated in FIG. 12, a height of the horizontal portion 58*b* of the relieving portion 58 is less by a height L1 than a height of the guide surface 56*a* of the guide member 56 in the apparatus height directions.

As illustrated in FIG. 12, in this exemplary embodiment, the ink supply tubes 42 extending from the ink tanks 26 extends leftward in the apparatus width directions along the guide section 54, form the curved portions 42*a* that are curved upward in the apparatus height directions until the curved portions 42*a* turn back rightward in the apparatus width directions, and further extend to be connected to the relay adapters 40 of the carriage unit 32. Therefore, when the carriage unit 32 is near the home position during movements along the apparatus width directions, the ink supply tubes 42 have a large surplus length so that a radius R1 of a curved portion 42*a*' (indicated by two-dot chain lines in FIG. 12) is relatively large and the curvature thereof is relatively small. On the other hand, when the carriage unit 32 moves away from the home position in the apparatus width directions, the surplus length of the ink supply tubes 42 becomes less so that the radius of the curved portion 42*a* becomes smaller and the curvature becomes larger.

When the curvature of the curved portion 42*a* of the ink supply tubes 42 is relatively large, the force that presses the curved portion 42*a* against the guide section 54 is relatively large, so that relatively large frictional force occurs between the curved portion 42*a* and the guide section 54. Due to this frictional force, the ink supply tubes 42 or the guide section 54 may be abraded and therefore damaged.

In this exemplary embodiment, as illustrated in FIG. 12, the relieving portion 58 is provided at a location in the apparatus width directions along the guide portion 54 at which the curved portion 42*a* of the ink supply tubes 42 is pressed against the guide section 54 by a maximum force, that is, at a location under a space in the apparatus height directions that the curved portion 42*a* occupies when the carriage unit 32 is at a left end of its movement region in the apparatus width directions. That is, the relieving portion 58 is provided at such a location as to receive the curved portion 42*a*.

In the relieving portion 58, the horizontal portion 58*b* of the relieving portion 58 is provided at a location that is lower by a height L1 than the guide surface 56*a* of the guide member 56, so that the horizontal portion 58*b* receives the curved portion 42*a* and contacts a lowermost site on the curved portion 42*a* in the apparatus height directions. This configuration allows the curved portion 42*a* on the horizontal portion 58*b* to have a radius R2 that, for example, is larger by the height L1 than a radius that the curved portion 42*a* has in the case where the horizontal portion 58*b* is at the same height as the guide surface 56*a* in the apparatus height directions. That is, the curvature of the curved portion 42*a* can be made smaller; in other words, the curve of the curved portion 42*a* can be made gentler. As a result, the force that presses the curved portion 42*a* against the guide section 54 can be made smaller, so that the damage that the ink supply tubes 42 or the guide section 54 may receive can be made less.

Carriage Unit

Referring to FIG. 6, FIG. 7, and FIG. 13, the carriage unit 32 includes a box-shaped casing 62 that has an opening at an upper side in the apparatus height directions. A bottom portion of the casing 62 is provided with an opening 62*a*. The recording head 44 (see FIG. 6) is attached to the opening 62*a* so that the nozzle surface of the recording head 44 protrudes downward from a bottom portion of the casing 62 in the apparatus height directions. In the casing 62, the relay adapters 40 are disposed above the recording head 44 in the apparatus height directions.

Furthermore, a front side of the casing 62 in the apparatus depth directions is provided with a tube guiding portion 62*b*. The tube guiding portion 62*b* is configured as a guiding portion that guides the ink supply tubes 42 extending from the relay adapters 40 to the front side in the apparatus depth directions so that the ink supply tubes 42 is curved leftward in the apparatus width directions.

As illustrated in FIG. 7, the tube guiding portion 62*b* includes a buffer portion 62*c* and a curved guide portion 62*d*. The buffer portion 62*c* is provided at the front side of the casing 62 in the apparatus depth directions and extends in the apparatus width directions. The buffer portion 62*c* is formed so as to define a space that has a predetermined height in the apparatus height directions. As illustrated in FIG. 13, a left end portion of the buffer portion 62*c* in the apparatus width directions is formed as a gently ascending slope and connects with the curved guide portion 62*d*.

The ink supply tubes 42 extending from the relay adapters 40 of the carriage unit 32 to the front side in the apparatus depth directions as illustrated in FIG. 4 turn leftward in the apparatus width directions at the front side in the apparatus depth directions within the buffer portion 62*c* and extends from the curved guide portion 62*d* to the outside of the carriage unit 32, that is, to the left side in the apparatus width directions.

Note that since the buffer portion 62*c* has a space with a predetermined height in the apparatus height directions, portions of the ink supply tubes 42 extending through the buffer portion 62*c* can be curved downward in the apparatus height directions. By curving a portion of the ink supply tubes 42 in the buffer portion 62*c* to the lower side in the apparatus height directions, the path length of the ink supply tubes 42 from the relay adapters 40 to the ink tanks 26 can be increased.

For example, during assembly of a printer 10, it sometimes happens that the ink supply tubes 42 are given a greater length than a shortest path from the relay adapters 40 to the ink tanks 26 and therefore have an extra length. However, such an extra length of the ink supply tubes 42 can be adjusted by curving the ink supply tubes 42 downward in the apparatus height directions within the buffer portion 62*c*.

Referring to FIG. 13, the curved guide portion 62*d* is curved downward in the apparatus height directions. That is, the curved guide portion 62*d* has a guiding shape that curves the ink supply tubes 42 so as to achieve the curve of the curved portion 42*a* of the ink supply tubes 42.

The curved guide portion 62*d* has a curved surface that has a radius R2. An imaginary circle C1 of the radius R2 indicated by a two-dot chain line is an imaginary circle that extends approximately along the curved surface of the curved guide portion 62*d*. In this exemplary embodiment, the radius R3 is set to such a value that the flows of inks through the ink supply tubes 42 are not inhibited when the ink supply tubes 42 are curved along the curved surface of the curved guide portion 62*d*. For example, the radius R3 is set within the range of 15 mm to 25 mm.

A one-dot chain line denoted by S1 in FIG. 13 is a straight line along an inclined surface of the inclined portion 58*a* of the relieving portion 58. In this exemplary embodiment, the straight line S1 is set as a tangent line to an imaginary circle C1. That is, the curved guide portion 62*d* and the relieving portion 58 are configured to guide the ink supply tubes 42 so that the curved portion 42*a* has the radius R2. Therefore, when the carriage unit 32 moves from right to left in the apparatus width directions, the ink supply tubes 42 follow the curved guide portion 62*d* and the relieving portion 58 and easily form the curved portion 42*a*.

Ink Supply Tubes

With reference to FIGS. 14 and 15, configuration of the ink supply tubes 42 will be described. As illustrated in FIG. 15, the ink supply tubes 42 are bundled by a clamp 64 so as to extend along the apparatus depth directions. A first protective member 66 is provided at an outer side of the ink supply tubes 42, that is, at an outer peripheral side of the curved portion 42*a*. The first protective member 66 is configured to cover and protect a portion of a path of the ink supply tubes 42 extending from the curved portion 42*a* toward the carriage unit 32 in the length directions of the ink supply tubes 42 and a portion of a path of the ink supply tubes 42 extending from the curved portion 42*a* toward the ink tanks 26 in the length directions of the ink supply tubes 42. For example, the first protective member 66 is a film member or a sheet shaped member that is made of resin or the like.

Furthermore, the first protective member 66 is provided with an enclosing portion 68 formed at a site corresponding to a location at which the ink supply tubes 42 are bundled by the clamp 64. For example, the enclosing portion 68 is formed by bending tongue shaped portions 66*a* (indicated by two-dot chain lines in FIG. 14) that protrude from side surfaces of the first protective member 66 to the front and rear sides in the apparatus depth directions in such a bending manner that the tongue shaped portions 66*a* enclose the ink supply tubes 42 and the clamp 64.

A second protective member 70 is provided at an inner side of the ink supply tubes 42, that is, at an inner periphery side of the curved portion 42*a*. For example, the second protective member 70 is configured to cover and protect a portion of a path of the ink supply tubes 42 extending from the enclosing portion 68 toward the carriage unit 32 in the length directions of the ink supply tubes 42 and a portion of a path of the ink supply tubes 42 extending from the enclosing portion 68 toward the ink tanks 26 in the length directions of the ink supply tubes 42. The second protective member 70 extends, at a location on the ink supply tubes 42 that corresponds to the enclosing portion 68, inside the enclosing portion 68 (i.e., between the enclosing portion 68 and the ink supply tubes 42). For example, the second protective member 70 is formed as a film member or a sheet shaped member that is made of resin or the like. The second protective member 70 is formed from a material that is lower in rigidity than that of the first protective member 66.

In this exemplary embodiment, as illustrated in FIG. 16, the location of the enclosing portion 68 is set so as to correspond to the location of the curved portion 42*a* of the ink supply tubes 42 when the carriage unit 32 is positioned at the left end of the movement region of the carriage unit 32 in the apparatus width directions.

At a location at which the enclosing portion 68 corresponds to the curved portion 42*a* of the ink supply tubes 42, the second protective member 70 is disposed between the enclosing portion 68 and the ink supply tubes 42. This prevents contact between the inner periphery side of the curved portion 42*a* of the ink supply tubes 42 and two opposite end edges of the enclosing portion 68 in the length directions of the ink supply tubes 42. That is, when the enclosing portion 68 is around the curved portion 42*a*, the opposite edges of the enclosing portion 68 do not directly contact the ink supply tubes 42 but contact the second protective member 70. This prevents occurrence of a defective state in which the edges of the enclosing portion 68 contact and damage the ink supply tubes 42.

Medium Discharge Roller Pair

With reference to FIGS. 17 and 18, configuration of the medium discharge roller pair 50 will be described. The driving discharge roller 50*a* is rotatably provided at the front side of the medium support member 46 in the apparatus depth directions, that is, a downstream side of the medium support member 46 in the transport path. The driving discharge roller 50*a* is configured to be rotationally driven by a drive source (not depicted). A roller support frame 72 is disposed at an upper side of the driving discharge roller 50*a* in the apparatus height directions. In this exemplary embodiment, for example, the roller support frame 72 is provided below the guide member 56 of the guide section 54 in the apparatus height directions. The roller support frame 72 supports the driven discharge roller 50*b* freely rotatably.

The roller support frame 72 is configured to be movable up and down in the apparatus height directions and switchable between a state in which the driven discharge roller 50*b* is in contact with the driving discharge roller 50*a* as illustrated in FIG. 17 and a state in which the driven discharge roller 50*b* is apart from the driving discharge roller 50*a* as illustrated in FIG. 18. In an example configuration, during the state in which the roller support frame 72 is displaced upward in the apparatus height directions so that the driven discharge roller 50*b* is apart from the driving discharge roller 50*a*, a tray with an optical disk or the like set thereon can be sent from the front side of the printer 10 in the apparatus depth directions into a region on the transport path in which the tray faces the recording head 44. Thus, recording on a label side of the optical disk or the like can be carried out.

Second Exemplary Embodiment

With reference to FIGS. 21 and 22, a carriage unit 76 in a second exemplary embodiment will be described. The carriage unit 76 is different from the carriage unit 32 in the first exemplary embodiment in that, in the carriage unit 76, a tube guiding portion 78*a* provided on the front side of a casing 78 in the apparatus depth directions includes a restricting portion 78*b*.

As illustrated in FIG. 21, the casing 78 of the carriage unit 76 has a box shape whose opening is formed on an upper side in the apparatus height directions. The front side of the casing 78 in the apparatus depth directions is provided with the tube guiding portion 78*a*. Note that the tube guiding portion 78*a* is configured so that the ink supply tubes 42 extending from a plurality of ink tanks 26 disposed in an ink tank section 24 are guided into the casing 78 by the tube guiding portion 78*a*.

The tube guiding portion 78*a* includes a buffer portion 78*c*, a curved guide portion 78*d*, and a tube holder portion 78*e*. The buffer portion 78*c* is configured to be substantially the same as the buffer portion 62*c* in the first exemplary embodiment. The curved guide portion 78*d* has a shape that is curved to a lower side in the apparatus height directions. The curved guide portion 78*d* has a guiding shape that curves the ink supply tubes 42. In this exemplary embodiment, the curved guide portion 78*d* is provided with the restricting portion 78*b* that has a rib shape protruding upward from the curved guide portion 78*d* in the apparatus height directions. In this exemplary embodiment, the restricting portion 78*b* is, for example, disposed at a left side in the apparatus width directions from a center position of the casing 78 of the carriage unit 76 in the apparatus width directions.

The rib-shaped restricting portion 78*b*, for example, has a width L3 in the apparatus width directions as indicated in FIG. 22. A distal end portion of the restricting portion 78*b* is not rounded so as to have a consistent radius of curvature. Instead, a positive X direction side corner portion and a negative X direction side corner portion of the distal end portion of the restricting portion 78*b* are chamfered so as to have round surfaces and a top surface of the distal end portion is shaped to have a radius (radius R3) that is larger than the radius of each chamfer. As illustrated in FIG. 24, the ink supply tubes 42 form a curved portion 42*a* along the curved guide portion 78*d*, with a portion of the ink supply tubes 42 being in contact with the restricting portion 78*b*. The radius R3 of the distal end portion of the restricting portion 78*b* is set in accordance with a radius R4 of the curved portion 42*a* of the ink supply tubes 42 (e.g., set so that the radius R3 and the radius R4 are substantially equal or the centers of the radius R3 and the radius R4 substantially coincide).

This configuration secures a contact area when the ink supply tubes 42 contacts the distal end portion of the restricting portion 78*b*, and therefore inhibits the restricting portion 78*b* from damaging the ink supply tubes 42.

As can be seen from FIGS. 21 to 23, two tube holder portions 78*e* having such an eave shape as to partially cover the curved guide portion 78*d* are provided above the curved guide portion 78*d* in the apparatus height directions. Each tube holder portion 78*e* has a width L2 in the apparatus width directions. In this exemplary embodiment, for example, the width L3 of the restricting portion 78*b* is smaller than the width L2 of the tube holder portions 78*e*.

For example, the tube holder portions 78*e*, as illustrated in FIG. 23, are in contact with two end portions of a first protective member 66 in its width directions (the apparatus depth directions). The first protective member 66, as in the first exemplary embodiment, is configured to protect an outer side of the ink supply tubes 42. Thus, by the tube holder portion 78*e*, the first protective member 66 is held relative to the curved guide portion 78*d*. As a result, the first protective member 66 can hold the ink supply tubes 42 disposed at the inner side of the first protective member 66 so that the ink supply tubes 42 do not fall apart from the curved guide portion 78*d*.

Now, with reference to FIGS. 24 and 25, postures of the ink supply tubes 42 during a state in which the carriage unit 76 is in a left end portion of the movement region of the carriage unit 76 in the apparatus width directions and during a state in which the carriage unit 76 is at the home position (in a right end portion of the movement region in the apparatus width directions) will be described.

As described above in conjunction with the first exemplary embodiment, the guide section 54 (FIG. 12) in the movement region of the carriage unit 76 includes the guide member 56 extending from the home position (at the right side in the apparatus width directions) to the left in the apparatus width directions and the relieving portion 58 provided at the left end portion of the movement region in the apparatus width directions.

In FIG. 12, when the carriage unit 32 is near the home position, the curved portion 42*a* of the ink supply tubes 42 is formed at a location apart from the carriage unit 32. In this state, the ink supply tubes 42 extending from the carriage unit 32 toward the left side in the apparatus width directions (a portion of the ink supply tubes 42 indicated by two-dot chain lines in FIG. 12) extend obliquely upward in the apparatus height directions and then form a curved portion 42*a*'. Although not depicted in FIG. 12, the scanner 14 is disposed above the carriage unit 32 and the ink supply tubes 42 in the apparatus height directions and the length of the ink supply tubes 42 extending from the curved portion 42*a* to the carriage unit 32 is at least partly in contact with the scanner 14.

When the carriage unit 32 is moved from this state to the left end in the apparatus width directions, the curved portion 42*a* of the ink supply tubes 42 is formed along the curved guide portion 62*d* of the carriage unit 32 as illustrated in FIG. 13, that is, the curved portion 42*a* is formed at a location near the carriage unit 32. Therefore, as compared with when the curved portion 42*a* is formed relatively far from the carriage unit 32 (e.g., when the carriage unit 32 is positioned at the right end in the apparatus width directions), the degree of freedom of the ink supply tubes 42 is reduced and the force that presses the curved portion 42*a* against the guide section 54 becomes maximum. In the first exemplary embodiment, because the relieving portion 58 is provided at the left end in the apparatus width directions, the curved portion 42*a* is allowed to partially escape downward into the relieving portion 58, so that the force that presses the curved portion 42*a* against the guide section 54 (FIG. 12) can be reduced.

To explain operation and effects of the rib-shaped restricting portion 78*b*, issues or problems of a configuration that is not provided with the restricting portion 78*b* will be described with reference to FIG. 30. Referring to upper part of FIG. 30, when a carriage unit 32 is relatively near to a right end (home position) in the apparatus width directions, ink supply tubes 42 extending from the carriage unit 32 assume a posture of extending obliquely upward in the apparatus height directions, so that the carriage unit 32 receives from the ink supply tubes 42 a force acting slightly upward as indicated by an arrow a.

On the other hand, when the carriage unit 32 is moved to a left end in the apparatus width directions as indicated in lower part of FIG. 30, the distance between the carriage unit 32 and the curved portion 42*a* becomes substantially eliminated and the curved portion 42*a* assumes a posture along the curved guide portion 62*d*, so that the carriage unit 32 receives a force acting downward as indicated by an arrow b from the ink supply tubes 42.

Thus, as the carriage unit 32 is moved, the force that the carriage unit 32 receives from the ink supply tubes 42 changes in direction. Therefore, there is a risk that the behavior of the carriage unit 32 may become unstable and the recording quality may decrease.

Therefore, in this exemplary embodiment, the rib-shaped restricting portion 78*b* is provided. The restricting portion 78*b* restricts the ink supply tubes 42 so that the ink supply tubes 42 extend toward the scanner 14, which is disposed at an upper side of the ink supply tubes 42 in the apparatus height (a side thereof in a direction away from the guide member 56). Therefore, the ink supply tubes 42 extending out from the curved guide portion 78*d* of the casing 78 is temporarily raised upward in the apparatus height directions, so that, during movements of the carriage unit 76, the force that the carriage unit 76 receives from the ink supply tubes 42 can be prevented from changing in direction or the degree of changes in the direction of force that the carriage unit 76 receives from the ink supply tubes 42 can be reduced.

That is, over the entire range of the movable region of the carriage unit 76, the direction of the force that the carriage unit 76 receives from the ink supply tubes 42 is kept slightly upward as indicated by the arrow a in the upper part of FIG. 30. Therefore, the behavior of the carriage unit 76 can be stabilized.

Furthermore, in this exemplary embodiment, since the restricting portion 78*b* restricts the ink supply tubes 42 so that the ink supply tubes 42 extend toward the scanner 14 disposed above the ink supply tubes 42 in the apparatus height directions, the region within the movement region of the carriage unit 76 (a portion of the movement region thereof) in which the ink supply tubes 42 are in contact with the scanner 14 can be increased. As a result, changes in the force that the carriage unit 76 receives from the ink supply tubes 42 can be reduced, so that the behavior of the carriage unit 76 during its movements can be stabilized.

Modifications of Second Exemplary Embodiment (1) A modification of the restricting portion will be described with reference to FIGS. 26 and 27. Referring to FIG. 26, a casing 82 of a carriage unit 80 has a curved guide portion 82*a* that is provided with a restricting portion 82*b*. The restricting portion 82*b* is formed, on an upper portion of the curved guide portion 82*a*, as a guiding surface that is inclined upward in the apparatus height directions (FIG. 27). The restricting portion 82*b* is capable of raising ink supply tubes 42 extending out of the carriage unit 80 to an upper side in the apparatus height directions, similarly to the restricting portion 78*b*. Therefore, the ink supply tubes 42 are raised upward in the apparatus height directions by the restricting portion 82*b* and then, beyond the restricting portion 82*b*, turn and curve downward in the apparatus height directions so as to form a curved portion 42*a*. As a result, during movements of the carriage unit 80, the force that the carriage unit 80 receives from the ink supply tubes 42 is prevented from changing in direction or the degree of change in the force that the carriage unit 80 receives from the ink supply tubes 42 is reduced, so that the behavior of the carriage unit 80 can be stabilized.

(2) Although the restricting portions 78*b* (FIG. 21) and 82*b* (FIG. 26) are formed integrally with the curved guide portions 78*d* and 82*a*, respectively, each of the restricting portions 78*b* and 82*b* may instead be a separate member. In a configuration in which the restricting portion 78*b* or 82*b* is provided as a separate member from the curved guide portion 78*d* or 82*a*, the rigidity of the restricting portion 78*b* or 82*b* is set lower than the rigidity of the casing 78 or 82 of the carriage unit 76 (FIG. 21) or 80 (FIG. 26).

Modifications of First and Second Exemplary Embodiments (1) Although in the first and second exemplary embodiments, the relieving portion 58, which is a "second site", is provided in the form of an inclined surface extending in a direction away from the ink supply tubes 42, the "second site" may instead be provided as a recess surface 74 that is formed in a surface of the guide section 54 so as to dip in a direction away from the ink supply tubes 42 as illustrated in FIG. 19. The location of the recess surface 74 on the guide section 54 in the apparatus width directions may be arbitrarily set.

(2) Although in the first and second exemplary embodiments, two longitudinally opposite end portions of the second protective member 70 that protects the inner periphery side of the curved portion 42*a* of the ink supply tubes 42 have a simple end shape that is formed, for example, when a sheet-shaped material of the second protective member 70 is cut linearly along the apparatus depth directions, each of the longitudinally opposite end portions of the second protective member 70 may instead have a relieving shape 70*a* as illustrated in FIG. 20. Each relieving shape 70*a* is, for example, a shape that curls to the inner periphery side of the curved portion 42*a* in FIG. 20. However, it suffices that the relieving shapes 70*a* are each such a shape that neither of two opposite end edges of the second protective member 70 damages the ink supply tubes 42.

(3) Although the roller support frame 72 is configured to be moved up and down in the apparatus height directions relative to and independently of the guide member 56, this configuration may be replaced by a configuration in which the guide member 56 is moved up and down in association with or integrally together with the roller support frame 72.

(4) In the first and second exemplary embodiments, the ink supply tubes 42 extending from the ink tanks 26 extend from right to left in the apparatus width directions at a lower side the carriage unit 32 (FIG. 6), 76 (FIG. 21), or 80 (FIG. 26) in the apparatus height directions, curve to an upper side in the apparatus height directions, then extend rightward in the apparatus width directions, and finally are led into the carriage unit 32, 76 or 80 and connected to the relay adapters 40. Instead of this configuration, a configuration in which the ink supply tubes 42 extending leftward from the ink tanks 26 in the apparatus width directions are positioned at the upper side of the carriage unit 32, 76 or 80 in the apparatus height directions, curve downward in the apparatus height directions, extend rightward in the apparatus width directions, and then are connected to the relay adapters 40 within the carriage unit 32, 76 or 80 may be adopted.

Furthermore, the ink supply tubes 42, instead of being curved to the upper or lower side in the apparatus height directions, may be curved to the front or rear side in the apparatus depth directions. That is, a configuration in which the ink supply tubes 42 are laid out in horizontal directions may be adopted. In such a configuration, the curved guide portion 62*d* (FIG. 7), 78*d* (FIG. 21), or 82*a* (FIG. 26), which is provided on the left side of the carriage unit 32, 76 or 80 in apparatus width directions, may instead be provided on a side of the carriage unit 32, 76 or 80 which faces the curved portion 42*a* of the ink supply tubes 42.

(5) The first protective member 66, which protects the outer side of the ink supply tubes 42, may be replaced by a first protective member 84 as illustrated in FIG. 28 and FIG. 29. The first protective member 84 has a slit 84*a* that is formed in a portion that covers and protects a portion of the ink supply tubes 42 extending from the curved portion 42*a* toward the carriage unit 32 in the length directions of the ink supply tubes 42 and a portion of the ink supply tubes 42 extending from the curved portion 42*a* toward the ink tanks 26.

In FIG. 28, the slit 84*a* is formed along the longitudinal direction of the first protective member 84. For example, the slit 84*a* is formed in a central portion of the first protective member 84 in its transverse direction (the apparatus depth directions). The provision of the slit 84*a* in the first protective member 84 makes the rigidity of the first protective member 84 lower than that of the first protective member 66. As a result, when the carriage unit 76 is moved in the movement region, the force that the first protective member 84 exerts on the carriage unit 76 can be reduced, so that the behavior of the carriage unit 76 can be further stabilized. The first protective member 84 is also provided with tongue shaped portions 84*b* that are bent to form an enclosing portion 86 (FIG. 29).

To recapitulate what has been described above, the printer 10 includes the carriage unit 32 that includes the recording head 44 for ejecting ink to a medium and that moves back and forth in the scanning directions of the recording head 44, the ink tanks 26 that are capable of storing ink that is to be ejected from the recording head 44 and that are provided at a different location from the carriage unit 32, the ink supply tubes 42 that are connected to the carriage unit 32 and that supply the carriage unit 32 with the ink sent from the ink tanks 26, and the guide section 54 that is located at a lower side of the carriage unit 32 in the apparatus height directions and that restricts the deformation of the ink supply tubes 42 which occurs as the carriage unit 32 moves and that extends along the moving directions of the carriage unit 32. When one of the moving directions of the carriage unit 32 is a first direction that is the rightward direction of the apparatus width directions and the other one of the moving directions is a second direction that is the leftward direction of the apparatus width directions, the ink supply tubes 42 extend in the second direction, that is, in the leftward direction of the apparatus width directions, along the guide section 54, form the curved portion 42*a* that curves to the upper side in the apparatus height directions, turn back into the first direction, that is, into the rightward direction of the apparatus width directions, and finally are connected to the carriage unit 32. The guide section 54 includes the guide member 56 and the relieving portion 58 that is lower than the guide member 56 in the apparatus height directions.

According to the foregoing configuration, since the guide section 54 that restricts deformation of the ink supply tubes 42 includes the guide member 56 and the relieving portion 58 that is lower than the guide member 56 in the apparatus height directions, it is possible to appropriately form the curved portion 42*a* due to the relieving portion 58 while reducing the size of the printer 10 and to prevent or reduce damage to the ink supply tubes 42 or the guide section 54.

The relieving portion 58 is provided at such a location as to receive the curved portion 42*a* of the ink supply tubes 42 when the carriage unit 32 is at a left end portion of the movable range in the apparatus width directions, that is, an end portion thereof in the second direction.

Since the ink supply tubes 42 extend in the leftward direction of the apparatus width directions, that is, in the second direction, along the guide section 54, form the curved portion 42*a*, turn back into the rightward direction of the apparatus width directions, that is, into the first direction, and then are connected to the carriage unit 32, the curved portion 42*a* contacts the guide section 54 most strongly when the carriage unit 32 is at the left end of the movable range of the carriage unit 32 in the apparatus width directions, that is, the end thereof in the second direction.

According to the foregoing configuration, since the relieving portion 58 is provided at such a location as to receive the curved portion 42*a* of the ink supply tubes 42 when the carriage unit 32 is at an end portion of the movable range in the leftward direction of the apparatus width directions, that is, in the second direction, the pressing contact of the curved portion 42*a* with the guide section 54 can be eased, so that damage to the ink supply tubes 42 or the guide section 54 can be effectively inhibited.

In the guide section 54, the relieving portion 58 is lower in rigidity than at least the guide member 56. According to this configuration, damage inflicted on the ink supply tubes 42 when the ink supply tubes 42 pressingly contacts the relieving portion 58 can be inhibited.

The relieving portion 58 has the inclined portion 58*a* that extends in a direction away from the ink supply tubes 42 or the recess surface 74 that dips in a direction away from the ink supply tubes 42.

The guide section 54 is located above the medium transport path.

The relieving portion 58 is located outside the medium transport path in the moving directions of the carriage unit 32. According to this configuration, the relieving portion 58 and the medium transport path do not overlap with each other when seen in the apparatus height directions, so that the dimension of the printer 10 in the apparatus height directions can be reduced.

The medium discharge roller pair 50 made up of the driving discharge roller 50*a* and the driven discharge roller 50*b* so as to send the medium out is provided downstream of the recording head 44 along the medium transport path. The roller support frame 72 that supports the driven discharge roller 50*b* is provided between the medium transport path and the guide section 54. The roller support frame 72 is displaceable in such directions that the interval between the roller support frame 72 and the medium transport path changes. The guide member 56 of the guide section 54 is displaced in the displacement directions of the roller support frame 72 in association with the roller support frame 72.

According to this configuration, since the guide member 56 of the guide section 54 is displaced in the displacement directions of the roller support frame 72 in association with the roller support frame 72 in the configuration in which the roller support frame 72 is displaceable in such directions as to change the interval between the roller support frame 72 and the medium transport path, the need to secure a large space between the roller support frame 72 and the guide section 54 is eliminated, so that increase in the size of the apparatus can be inhibited.

The carriage unit 32 includes the curved guide portion 62*d* that curves the ink supply tubes 42 so that the ink supply tubes 42 follow the curve of the curved portion 42*a*. According to this configuration, the curved portion 42*a* of the ink supply tubes 42 can be easily formed.

The printer 10 also includes the plurality of ink supply tubes 42, the clamp 64 that bundles the ink supply tubes 42, the first protective member 66 that covers and protects at least a portion of the ink supply tubes 42 in their length directions which extends from the curved portion 42*a* toward the carriage unit 32 and at least a portion of the ink supply tubes 42 in their length directions which extends from the curved portion 42*a* toward the ink tanks 26, the two portions including an outer side of the curved portion 42*a* of the ink supply tubes 42, the enclosing portion 68 that is provided integrally together with the first protective member 66 and that encloses the clamp 64, and the second protective member 70 that is provided at the inner side of the curved portion 42*a* of the ink supply tubes 42 and interposed between the clamp 64 and the enclosing portion 68 and that covers and protects at least a portion of the ink supply tubes 42 in their length directions which extends from the enclosing portion 68 toward the carriage unit 32 and at least a portion of the ink supply tubes 42 in their length directions which extends from the enclosing portion 68 toward the ink tanks 26.

According to this configuration, the clamp 64 can hold the ink supply tubes 42 together, the first protective member 66 can protect the ink supply tubes 42, and the enclosing portion 68 can integrate the ink supply tubes 42, the clamp 64, and the first protective member 66 together. In this configuration, due to the second protective member 70 that is provided at the inner side of the curved portion 42*a* of the ink supply tubes 42 and interposed between the clamp 64 and the enclosing portion 68 and that extends from the enclosing portion 68 in both opposite longitudinal directions of the ink supply tubes 42, it is possible to prevent the enclosing portion 68 from digging into the ink supply tubes 42.

The second protective member 70 is lower in rigidity than the first protective member 66. According to this configuration, it is possible to avoid the second protective member 70 digging into the ink supply tubes 42.

End portions of the second protective member 70 in the longitudinal direction of the ink supply tubes 42 are each provided with the relieving shape 70*a* that avoids digging into the ink supply tubes 42. According to this configuration, it is possible to certainly avoid the digging of the second protective member 70 into the ink supply tubes 42.

The printer 10 includes, the carriage unit 76 (FIG. 21) or 80 (FIG. 26) that includes the recording head 44 for ejecting ink to a medium and that moves back and forth in the scanning directions of the recording head 44, the ink tanks 26 that are capable of the ink that is to be ejected from the recording head 44 and that are provided a different location from the carriage unit 76 or 80, the ink supply tubes 42 that are connected to the carriage unit 76 or 80 and that supply the carriage unit 76 or 80 with the ink sent from the ink tanks 26, and the guide section 54 that is located at the lower side of the carriage unit 32 in the apparatus height directions and that restricts deformation of the ink supply tubes 42 which occurs as the carriage unit 76 or 80 moves and that extends along the moving directions of the carriage unit 76 or 80. When one of the moving directions of the carriage unit 76 or 80 is a first direction that is the rightward direction of the apparatus width directions and the other one of the moving directions is a second direction that is the leftward direction of the apparatus width directions, the ink supply tubes 42 extend in the second direction, that is, in the leftward direction of the apparatus width directions, along the guide section 54, form the curved portion 42*a* that curves to the upper side in the apparatus height directions, turn back into the first direction, that is, into the rightward direction of the apparatus width directions, and then are connected to the carriage unit 76 or 80. The carriage unit 76 or 80 includes the restricting portion 78*b* (FIG. 21) or 82*b* (FIG. 26) that restricts the extending-out direction in which the ink supply tubes 42 extend out from the carriage unit 76 or 80 toward a direction away from the guide section 54.

According to this configuration, since the carriage unit 76 or 80 includes the restricting portion 78*b* or 82*b* that restricts the extending-out direction in which the ink supply tubes 42 extend out from the carriage unit 76 or 80 toward a direction away from the guide section 54, the ink supply tubes 42 are restricted so that the radius of the curved portion 42*a* is maximized. In particular, when the carriage unit 76 or 80 is moved from a leftward end portion in the apparatus width directions to the right side in the apparatus width directions, the change in the extending-out direction of the ink supply tubes 42 can be reduced or inhibited, so that changes in the force that the carriage unit 76 or 80 receives from the ink supply tubes 42 due to changes in the curvature of the curved portion 42*a* during moving actions of the carriage unit 76 or 80 can be inhibited. As a result, destabilization of behavior of the carriage unit 76 or 80 and therefore deterioration of recording quality occurring due to the carriage unit 76 or 80 receiving forces from the ink supply tubes 42 can be inhibited.

The printer 10 includes the carriage unit 76 (FIG. 21) or 80 (FIG. 26) that includes the recording head 44 for ejecting ink to a medium and that moves back and forth in the scanning directions of the recording head 44, the ink tanks 26 that are capable of storing the ink that is to be ejected from the recording head 44 and that are provided at a different location from the carriage unit 76 or 80, the ink supply tubes 42 that are connected to the carriage unit 76 or 80 and that supply the carriage unit 76 or 80 with the ink sent from the ink tanks 26, and the guide section 54 that is located at a lower side of the carriage unit 76 or 80 in the apparatus height directions and that restricts the deformation of the ink supply tubes 42 which occurs as the carriage unit 76 or 80 moves and that extends along the moving directions of the carriage unit 76 or 80. When one of the moving directions of the carriage unit 76 or 80 is a first direction that is the rightward direction of the apparatus width directions and the other one of the moving directions is a second direction that is the leftward direction of the apparatus width directions, the ink supply tubes 42 extend in the second direction, that is, in the leftward direction of the apparatus width directions, along the guide section 54, form the curved portion 42*a* that curves to the upper side in the apparatus height directions, turn back into the first direction, that is, into the rightward direction of the apparatus width directions, and then are connected to the carriage unit 32. The carriage unit 76 or 80 includes the restricting portion 78*b* (FIG. 21) or 82*b* (FIG. 26) that restricts the extending-out direction in which the ink supply tubes 42 extend out from the carriage unit 76 or 80 toward a direction toward the scanner 14.

If the ink supply tubes 42 extending out from the carriage unit 76 or 80 sometimes contact and some other times do not contact the scanner 14 located above the region of back and forth movements of the carriage unit 76 or 80, the force that the carriage unit 76 or 80 receives from the ink supply tubes 42 during moving actions of the carriage unit 76 or 80 changes and therefore behavior of the carriage unit 76 or 80 becomes unstable.

However, according to this configuration, since the carriage unit 76 or 80 includes the restricting portion 78*b* or 82*b* that restricts the extending-out direction of the ink supply tubes 42 extending out from the carriage unit 76 or 80 to a direction toward the scanner 14, the range over which the ink supply tubes 42 contact the scanner 14 can be extended. As a result, the force that the carriage unit 76 or 80 receives from the ink supply tubes 42 during the moving actions of the carriage unit 76 or 80 is inhibited from changing, so that it is possible to inhibit destabilization of behavior of the carriage unit 76 or 80 and therefore deterioration of recording quality.

The printer 10 also includes the first protective member 84 that covers and protects at least a portion of the ink supply tubes 42 in their length directions which extends from the curved portion 42*a* toward the carriage unit 76 or 80 and at least a portion of the ink supply tubes 42 in their length directions which extends from the curved portion 42*a* toward the ink tanks 26, the two portions including an outer side of the curved portion 42*a* of the ink supply tubes 42. The first protective member 84 has at least in a portion thereof that protects the curved portion 42*a* the slit 84*a* formed in the length directions of the ink supply tubes 42.

According to this configuration, since the first protective member 84 has at least in the portion thereof that protects the curved portion 42*a* the slit 84*a* formed in the length directions of the ink supply tubes 42, the rigidity of the first protective member 84 can be reduced, so that the force that the carriage unit 76 or 80 receives from the first protective member 84 can be inhibited. As a result, destabilization of behavior of the carriage unit 76 or 80 and therefore deterioration of recording quality occurring due to the carriage unit 76 or 80 receiving force from the first protective member 84 can be inhibited.

Furthermore, although in this exemplary embodiment, the guide section 54, the relieving portion 58, and the curved guide portion 62*d* according to the invention are applied to an ink jet printer as an example of a liquid ejecting apparatus, the guide section 54, the relieving portion 58, and the curved guide portion 62*d* can also be applied to other liquid ejecting apparatuses in general.

Note that the liquid ejecting apparatus mentioned herein is not limited to recording apparatuses, such as printers, copying machines and facsimiles, that employ an ink jet type recording head and that perform recording on a recording medium by ejecting ink from the recording head, but also includes various other apparatuses that eject, instead of ink, liquids corresponding to their uses from liquid ejecting heads that correspond to the aforementioned ink jet type recording head to ejection target media that correspond to the aforementioned recording medium so that the liquids adhere to the ejection target media.

Examples of the liquid ejecting head include, besides the foregoing recording heads, color material ejecting heads for use in producing color filters of liquid crystal displays and the like, electrode material (electroconductive paste) ejecting heads for use in forming electrodes of organic electroluminescence (EL) displays, surface emission displays (FEDs), etc., bioorganic material ejecting heads, sample ejecting heads provided as precision pipettes for use in biochip production, etc.

It should be apparent that the invention is not limited to the foregoing exemplary embodiments or the like but can be modified or changed in various manners within the scope of the invention described in the appended claims and that such modifications and changes are encompassed within the scope of the invention.

The entire disclosure of Japanese Patent Application No. 2016-215871, filed Nov. 4, 2016 and 2017-073840, filed Apr. 3, 2017 are expressly incorporated by reference herein.

What is claimed is:

1. A liquid ejecting apparatus comprising:

a carriage unit that includes a liquid ejecting head for ejecting a liquid to a medium and;

a liquid storing container which is capable of storing the liquid that is to be ejected from the liquid ejecting head and which is provided at a different location from the carriage unit;

a tube that is connected to the carriage unit and that supplies the liquid sent from the liquid storing container; and a guide section that is located at a lower side of the carriage unit in a vertical direction, wherein when one of the moving directions of the carriage unit is a first direction and another one of the moving directions of the carriage unit is a second direction, the tube extends in the second direction along the guide section, forms a curved portion that curves vertically upward, turns back into the first direction, and then is connected to the carriage unit, and wherein the guide section includes a first site and a second site that is lower in the vertical direction than the first site, wherein the second site is provided at such a location as to receive the curved portion of the tube when the carriage unit is at an end portion of a movable range of the carriage unit in the second direction.

2. The liquid ejecting apparatus according to claim 1, wherein the second site is lower in rigidity than at least the first site.

3. The liquid ejecting apparatus according to claim 1, wherein the second site has an inclined surface extending in a direction away from the tube or a recess surface that dips in a direction away from the tube.

4. The liquid ejecting apparatus according to claim 1, wherein the guide section is located above a medium transport path.

5. The liquid ejecting apparatus according to claim 4, wherein the second site is located outside the medium transport path in the moving directions of the carriage unit.

6. The liquid ejecting apparatus according to claim 4, further comprising:

a medium discharge roller pair that is provided at a downstream side of the liquid ejecting head in the medium transport path and that includes a driving discharge roller and a driven discharge roller that together send out the medium; and a roller support frame that is provided between the medium transport path and the guide section and that supports the driven discharge roller, wherein the roller support frame is displaceable in such a direction that an interval between the roller support frame and the medium transport path changes, and the first site of the guide section is displaced in a displacement direction of the roller support frame in association with the roller support frame.

7. The liquid ejecting apparatus according to claim 1, wherein the carriage unit includes a curved guide portion that curves the tube so that the tube follows a curve of the curved portion of the tube.

8. The liquid ejecting apparatus according to claim 1, comprising:

a plurality of the tube;

a clamp that bundles the plurality of the tube;

a first protective member that covers and protects at least a first portion of the tubes in a length direction of the tubes which extends from the curved portion toward the carriage unit and at least a second portion of the tubes in the length direction of the tubes which extends from the curved portion toward the liquid storing container, the first portion and the second portion together including an outer side of the curved portion of the tubes;

an enclosing portion that is provided integrally together with the first protective member and that encloses the clamp; and a second protective member that is provided at an inner side of the curved portion of the tubes and interposed between the clamp and the enclosing portion and that covers and protects at least a portion of the tubes in a length direction of the tubes which extends from the enclosing portion toward the carriage unit and at least a portion of the tubes in the length direction of the tube which extends from the enclosing portion toward the liquid storing container.

9. The liquid ejecting apparatus according to claim 8, wherein the second protective member is lower in rigidity than the first protective member.

10. The liquid ejecting apparatus according to claim 8, wherein an end portion of the second protective member in a longitudinal direction of the tube has such a relieving shape as to avoid digging of the end portion into the tube.

11. A liquid ejecting apparatus comprising:

a carriage unit that includes a liquid ejecting head for ejecting a liquid to a medium;

a liquid storing container which is capable of storing the liquid that is to be ejected from the liquid ejecting head and which is provided at a different location from the carriage unit;

a tube that is connected to supplies the liquid sent from the liquid storing container; and a guide section that is located at a lower side of the carriage unit in a vertical direction, wherein when one of the moving directions of the carriage unit is a first direction and another one of the moving directions of the carriage unit is a second direction, the tube extends in the second direction along the guide section, forms a curved portion that curves vertically upward, turns back into the first direction, and then is connected to the carriage unit, wherein the carriage unit includes a restricting portion that restricts an extending-out direction in which the tube extends out from the carriage unit toward a direction away from the guide section, and wherein the restricting portion is provided at such a location as to receive the curved portion of the tube when the carriage unit is at an end portion of a movable range of the carriage unit in the second direction.

12. The liquid ejecting apparatus according to claim 11, further comprising a first protective member that covers and protects at least a first portion of the tube in a length direction of the tube which extends from the curved portion toward the carriage unit and at least a second portion of the tube in the length direction of the tube which extends from the curved portion toward the liquid storing container, the first portion and the second portion together including an outer side of the curved portion of the tubes, wherein the first protective member has in at least a region in the first protective member which protects the curved portion a slit formed along the length direction of the tube.

13. A liquid ejecting apparatus comprising:

a carriage unit that includes a liquid ejecting head for ejecting a liquid to a medium;

a liquid storing container which is capable of storing the liquid that is to be ejected from the liquid ejecting head and which is provided at a different location from the carriage unit;

a tube that is connected to supplies the liquid sent from the liquid storing container;

a guide section that is located at a lower side of the carriage unit in a vertical direction and that restricts deformation of the tube occurring as the carriage unit moves and that extends along moving directions of the carriage unit; and an opening/closing body that is located at an upper side of the carriage unit in a vertical direction and that opens and closes a region of back and forth movements of the carriage unit, wherein when one of the moving directions of the carriage unit is a first direction and another one of the moving directions of the carriage unit is a second direction, the tube extends in the second direction along the guide section, forms a curved portion that curves vertically upward, turns back into the first direction, and then is connected to the carriage unit, wherein the carriage unit includes a restricting portion that restricts an extending-out direction in which the tube extends out from the carriage unit toward a direction toward the opening/closing body, and wherein the restricting portion is provided at such a location as to receive the curved portion of the tube when the carriage unit is at an end portion of a movable range of the carriage unit in the second direction.

* * * * *